US008014691B2

(12) United States Patent
Inukai et al.

(10) Patent No.: US 8,014,691 B2
(45) Date of Patent: Sep. 6, 2011

(54) METHOD OF MEASURING AND ADJUSTING DENSITY OF LIQUID DEVELOPER BY DETECTING MOVEMENT OF MOVING MEMBER IN LIGHT PATH

(75) Inventors: Teruyuki Inukai, Matsumoto (JP); Toru Tanjo, Shiojiri (JP); Tsutomu Sasaki, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 473 days.

(21) Appl. No.: 12/196,193

(22) Filed: Aug. 21, 2008

(65) Prior Publication Data

US 2009/0053407 A1 Feb. 26, 2009

(30) Foreign Application Priority Data

Aug. 24, 2007 (JP) ..... 2007-217849
Jun. 26, 2008 (JP) ..... 2008-167193

(51) Int. Cl.
*G03G 15/00* (2006.01)

(52) U.S. Cl. ..... 399/57

(58) Field of Classification Search ..... 399/57, 399/237, 49, 58, 61, 62, 64
See application file for complete search history.

(56) References Cited

U.S. PATENT DOCUMENTS 5,960,231 A * 9/1999 Martinez ..... 399/30
5,991,559 A * 11/1999 Suetsugu et al. ..... 399/57
6,603,934 B2 * 8/2003 Shimmura ..... 399/49
2003/0175049 A1 * 9/2003 Ichida et al. ..... 399/237
2004/0197116 A1 * 10/2004 Yoshino et al. ..... 399/237

FOREIGN PATENT DOCUMENTS

JP 04080780 A * 3/1992
JP 09243559 A * 9/1997
JP 2000-249653 9/2000

OTHER PUBLICATIONS

Computer Translation: JP09-243559A, Sep. 19, 1997.*

* cited by examiner

*Primary Examiner* — Quana M Grainger
(74) *Attorney, Agent, or Firm* — DLA Piper LLP (US)

(57) ABSTRACT

A method of measuring density includes detecting movement of a moving member in a light path of light emitted from a light emitting member, measuring an output of a light receiving member for a case where the moving member is moved in the light path, as a first output, detecting that the moving member is not in the light path, measuring an output of the light receiving member for a case where the moving member is not in the light path, as a second output, and calculating density based on the first output and the second output.

16 Claims, 22 Drawing Sheets

MEASUREMENT FLOWCHART

METHOD OF MEASURING AND ADJUSTING DENSITY OF LIQUID DEVELOPER BY DETECTING MOVEMENT OF MOVING MEMBER IN LIGHT PATH

BACKGROUND

1. Technical Field

The present invention relates to a method of measuring density, a method of adjusting density of a liquid developer storing unit, and an image forming method capable of measuring density of liquid toner acquired from dispersing toner into a carrier liquid.

2. Related Art

There has been a method capable of detecting the density of a liquid in the broad range (see JP-A-2000-249653). In the method, a liquid as a target for density measurement is filled in concave parts that are formed in multi-level parts between the eccentric disc part and two disc parts in the circumferential direction by using a liquid carrying roller formed by integrally forming an eccentric disc part and two disc parts that have a same diameter larger than that of the eccentric disc and have the eccentric disc part interposed there between. Then, the liquid is formed to have a plurality of film thicknesses corresponding to the multi-levels, and the density of the liquid is detected based on the output of an optical sensor for the plurality of the film thicknesses.

However, in the technology disclosed in JP-A-2000-249653, at least two shafts of the disc parts and the eccentric disc part are needed, and a large space is required. In addition, a gap in the circumference is detected, thus an electrical process cannot be easily performed. In addition, the developer is needed to be pumped from a storage unit by using a pump or the like, the number of constituent components is increased. In addition, since the density of the pumped developer is detected, the density is not identical to that of the developer inside the storage unit.

SUMMARY

An advantage of some aspects of the invention is that it provides a method of measuring density, a method of adjusting density of a liquid developer storing unit, and an image forming method capable of precisely measuring the density of a liquid.

According to a first aspect of the invention, there is provided a method of measuring density including: detecting movement of a moving member in a light path of light emitted from a light emitting member; measuring an output of a light receiving member for a case where the moving member is moved in the light path, as a first output; detecting that the moving member is not in the light path; measuring an output of the light receiving member for a case where the moving member is not in the light path, as a second output; and calculating density based on the first output and the second output. Accordingly, the liquid is not needed to be pumped from a storage unit by using a pump or the like, and thus the number of components is decreased. In addition, since the moving member is moved in the gap, a new liquid can come into the gap and accordingly, it is possible to precisely measure the density of the liquid.

In addition, in the above-described method, the measuring of the first output may include receiving the light emitted from the light emitting member through the moving member that has optical transparency by using the light receiving member. In such a case, it is possible to form a change in the light path that is formed from the light emitting member to the light receiving member in a simple manner.

In addition, the above-described method may further includes: measuring an output of a second light receiving member for a case where the second light receiving member receives light emitted from the light emitting member not through the moving member, as a third output; and correcting the second output by using the third output. Accordingly, the density can be measured more accurately.

According to a second aspect of the invention, there is provided a method of adjusting density of a liquid developer storing unit. The method includes: measuring an output of a light receiving member for a case where a moving member is moved in a light path of light emitted from a light emitting member of a liquid developer storing unit that stores liquid developer having solids and a liquid carrier, as a first output; measuring an output of the light receiving member for a case where the moving member is not in the light path, as a second output; calculating density of the solids of the liquid developer based on the first output and the second output; and supplying the liquid developer or the carrier liquid to the inside of the liquid developer storing unit in accordance with the calculated density of the solids. Accordingly, the density inside the liquid developer storing unit can be precisely adjusted.

In addition, in the above-described method, the measuring of the first output may be receiving light emitted from the light emitting member through the moving member having optical transparency by using the light receiving member. In such a case, it is possible to form a change in the light path that is formed from the light emitting member to the light receiving member in a simple manner.

In addition, the above-described method may further includes: measuring an output of a second light receiving member for a case where the second light receiving member receives light emitted from the light emitting member not through the moving member, as a third output; and correcting the second output by using the third output. In such a case, the density can be measured more accurately.

In addition, the above-described method may further includes supplying the liquid developer into the liquid developer storing unit in a case where the calculated density of the solids is first density of the solids that is smaller than a predetermined value. In such a case, it is possible to precisely adjust the density of the liquid developer in a case where the density of the liquid developer inside the liquid developer storing unit is low.

In addition, the above-described method may further supplying the carrier liquid into the liquid developer storing unit in a case where the calculated density of the solids is second density of the solids that is larger than the predetermined value. In such a case, it is possible to precisely adjust the density of the liquid developer in a case where the density of the liquid developer inside the liquid developer storing unit is high.

In addition, the above-described method may further includes: calculating a liquid level of the liquid developer inside the liquid developer storing unit; and supplying the liquid developer or the carrier liquid into the liquid developer storing unit based on calculated the liquid level. Accordingly, it is possible to precisely adjust the density of the liquid developer inside the liquid developer storing unit.

In addition, the above-described method may further prohibiting input of the liquid developer in a case where the liquid level is a first liquid level that is higher than a first predetermined liquid level. In such a case, an overflow or the like from the liquid developer storing unit can be prevented.

According to a third aspect of the invention, there is provided an image forming method including: supplying liquid developer having solids and a liquid carrier which is stored in a developer container from a developer supplying member to a developer carrier; developing a latent image on an image carrier by using the liquid developer carried on the developer carrier; transferring the image of the image carrier by using a transfer member; collecting the liquid developer from the developer container into the liquid developer storing unit; detecting that a moving member is moved in a light path of light emitted from a light emitting member of the liquid developer storing unit; measuring an output of the light receiving member for a case where the moving member is moved in the light path, as a first output; detecting that the moving member is not in the light path; measuring an output of the light receiving member for a case where the moving member is not in the light path, as a second output; calculating density of the solids of the liquid developer based on the first output and the second output; and changing an image forming condition based on the calculated density of the solids. Accordingly, an image having excellent image quality can be formed.

In addition, the above-described image forming method may further include supplying the liquid developer or the carrier liquid to the inside of the liquid developer storing unit in accordance with the calculated density of the solids. In such a case, it is possible to precisely adjust the density of the liquid developer inside the liquid developer storing unit, and accordingly, an image having higher image quality can be formed.

In addition, the image forming method may further include stopping printing in a case where the calculated density of the solids is a third density of the solids that is higher than a first predetermined density or a fourth density that is lower than a second predetermined density lower than the first predetermined density. In such a case, formation of an image having deteriorated image quality can be reduced.

In addition, the above-described image forming method may further include controlling the number of rotations of the developer supplying member in accordance with the calculated density of the solids. In such a case, it is possible to form an image having higher image quality.

In addition, the above-described image forming method may further include controlling a bias of a developer compressing member in accordance with the calculated density of the solids. In such a case, it is possible to form an image having higher image quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the present invention will be described with reference to the accompanying drawings.

Figure 1:
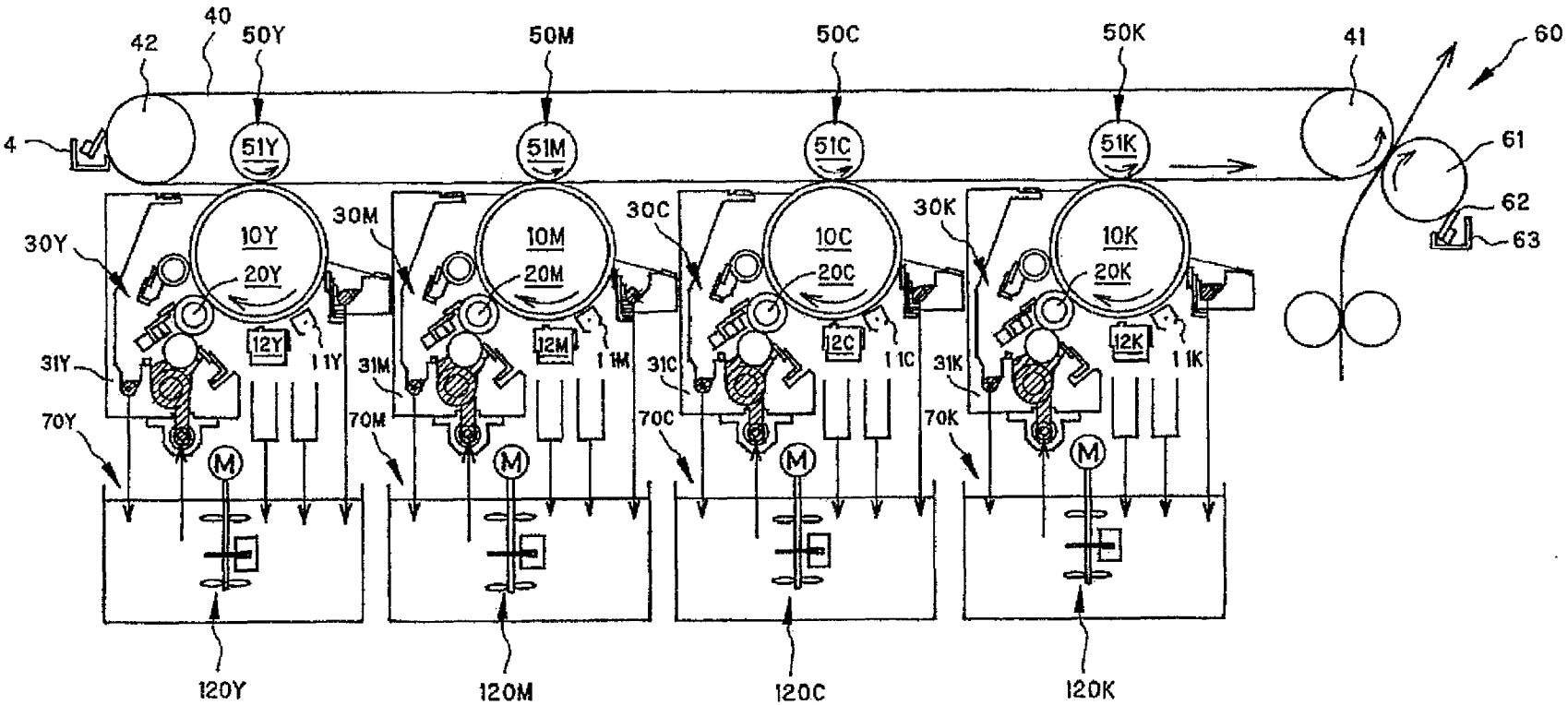
FIG. 1 is a diagram showing an image forming apparatus according to an embodiment of the invention.

FIG. 1 is a diagram showing major elements constituting an image forming apparatus according to an embodiment of the invention. In a center part of the image forming apparatus, image forming units for each color are disposed. In addition, developing units 30Y, 30M, 30C, and 30K and developer collecting and supplying devices 70Y, 70M, 70C, and 70K are disposed in a lower part of the image forming apparatus. In addition, an intermediate transfer body 40 and a secondary transfer unit 60 are disposed in an upper part of the image forming apparatus.

The image forming units include image carriers 10Y, 10M, 10C, and 10K, corona chargings 11Y, 11M, 11C, and 11K, exposure units 12Y, 12M, 12C, and 12K, and the like. The exposure units 12Y, 12M, 12C, and 12K are constituted by line heads, in which LEDs or the like are aligned, and the like. The corona charging 11Y, 11M, 11C, and 11K electrically charge the image carriers 10Y, 10M, 10C, and 10K in a same manner, the exposure units 12Y, 12M, 12C, and 12K emit laser beams that have been modulated based on an input image signal, and electrostatic latent images are formed on the charged image carriers 10Y, 10M, 10C, and 10K.

The developing units 30Y, 30M, 30C, and 30K include developing rollers 20Y, 20M, 20C, and 20K, developer containers 31Y, 31M, 31C, and 31K that store each one of liquid developers of colors including yellow Y, magenta M, cyan C, and black K, and developer supplying rollers 32Y, 32M, 32C, and 32K that supply each one of the liquid developers of the colors from the developer containers 31Y, 31M, 31C, and 31K to the developing rollers 20Y, 20M, 20C, and 20K. The developing units 30Y, 30M, 30C, and 30K develop the electrostatic latent images formed on the image carriers 10Y, 10M, 10C, and 10K by using the liquid developers of the colors.

The intermediate transfer body 40 is an endless belt member. The intermediate transfer body 40 is tightly wound to extend between a driving roller 41 and a tension roller 42. While being brought into contact with the image carriers 10Y, 10M, 10C, and 10K by primary transfer units 50Y, 50M, 50C, and 50K, the intermediate transfer body 40 is driven to rotate by the driving roller 41. Primary transfer rollers 51Y, 51M, 51C, and 51K of the primary transfer units 50Y, 50M, 50C, and 50K are disposed to face the image carriers 10Y, 10M, 10C, and 10K with the intermediate transfer body 40 interposed therebetween. The primary transfer units 50Y, 50M, 50C, and 50K sequentially transfer developed toner images of each color formed on the image carriers 10Y, 10M, 10C, and 10K on the intermediate transfer body 40 in a superposing manner by using contact positions between the image carriers 10Y, 10M, 10C, and 10K and the image carriers 10Y, 10M, 10C, and 10K as transfer positions, and thereby forming a full-color toner image.

A secondary transfer roller 61 of the secondary transfer unit 60 is disposed to face the belt driving roller 41 with the intermediate transfer body 40 interposed therebetween. In addition, in the secondary transfer unit 60, a cleaning device including a secondary transfer roller cleaning blade 62 and a developer collecting unit 63 is disposed. The secondary transfer unit 60 transports and supplies a sheet member such as a paper sheet, a film, or a cloth to a sheet member transporting path L in accordance with a timing at which a full-color toner image formed by superposing colors on the intermediate transfer body 40 or a monochrome toner image arrives at the transfer position of the secondary transfer unit 60 and performs a secondary transfer process for the monochrome toner image or the full-color toner image on the sheet member. On the rear side of the sheet member transporting path L, a fixing unit that is not shown in the figure is disposed. By fusing and fixing the monochrome toner image or the full-color toner image transferred on the sheet member on a recording medium (sheet member) such as a paper sheet, an operation for forming a final image on the sheet member is completed.

On the side of the tension roller 42 that tightly supports the intermediate transfer body 40 together with the belt driving roller 41, a cleaning device including an intermediate transfer body cleaning blade 46 and a developer collecting unit 47 is disposed along the outer periphery of the tension roller 42 is disposed. After passing through the secondary transfer unit 60, the intermediate transfer body 40 advances to a winding part of the tension roller 42. Then, a cleaning operation for the intermediate transfer body 40 is performed by the intermediate transfer body cleaning blade 46, and the intermediate transfer body 40 advances toward the primary transfer units 50 again.

The developer collecting and supplying devices 70Y, 70M, 70C, and 70K adjust the density of the liquid developer that has been collected from the image carriers 10Y, 10M, 10C, and 10K and the developing units 30Y, 30M, 30C, and 30K and supplies the liquid developer to the developer containers 31Y, 31M, 31C, and 31K.

Figure 2:
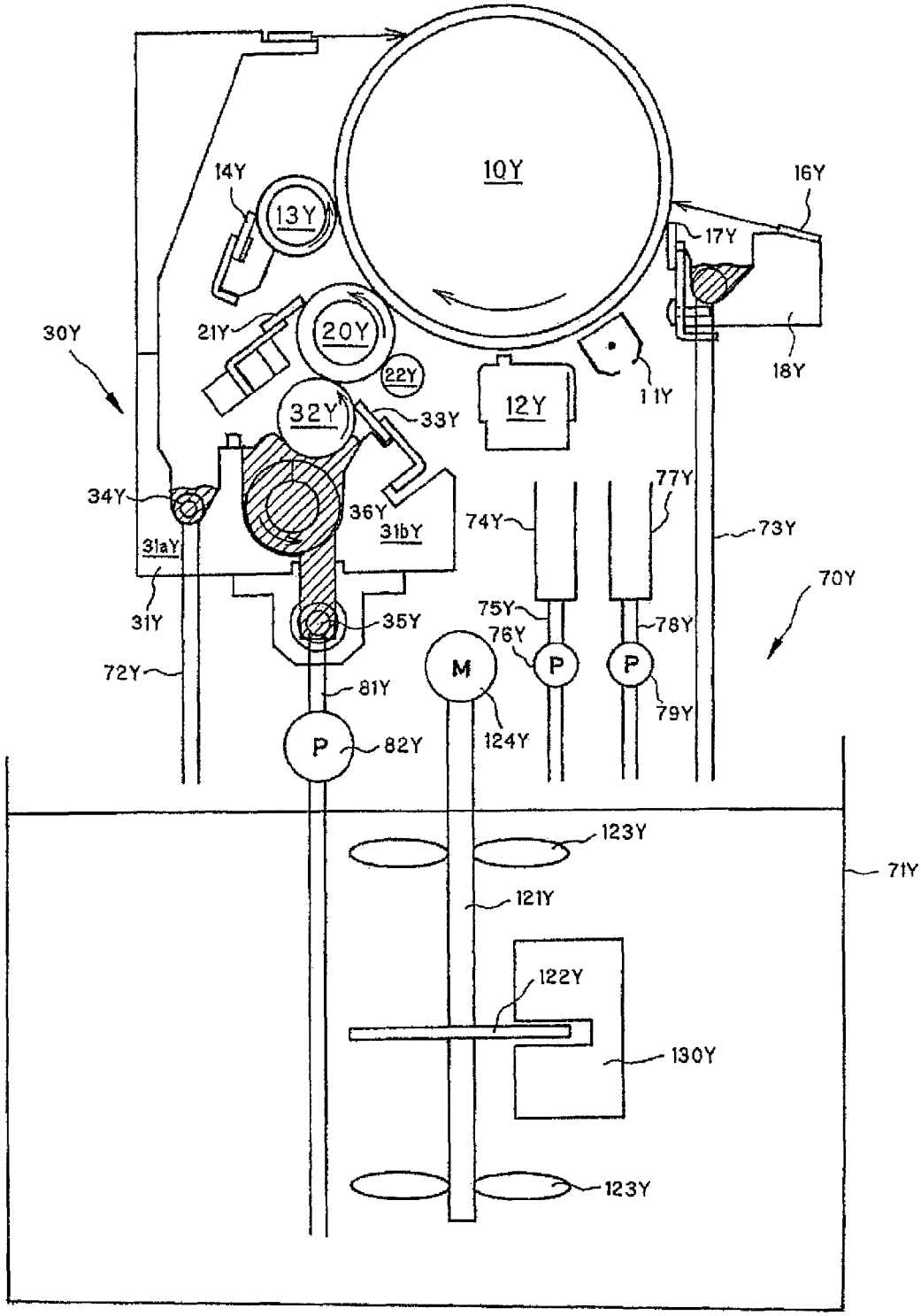
FIG. 2 is a cross-section view showing major constituent elements of an image forming unit and a developing unit according to an embodiment of the invention.
Figure 3:
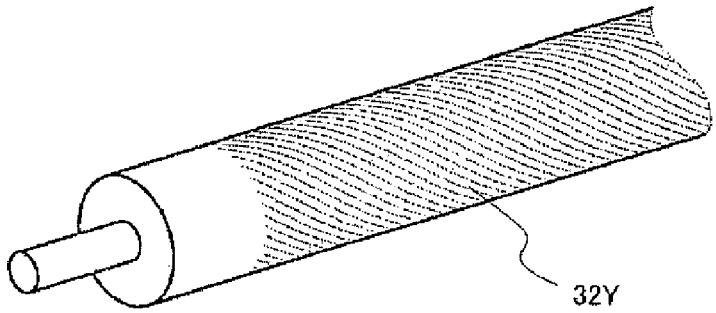
FIG. 3 is a perspective view of a developer supplying member according to an embodiment of the invention.
Figure 4:
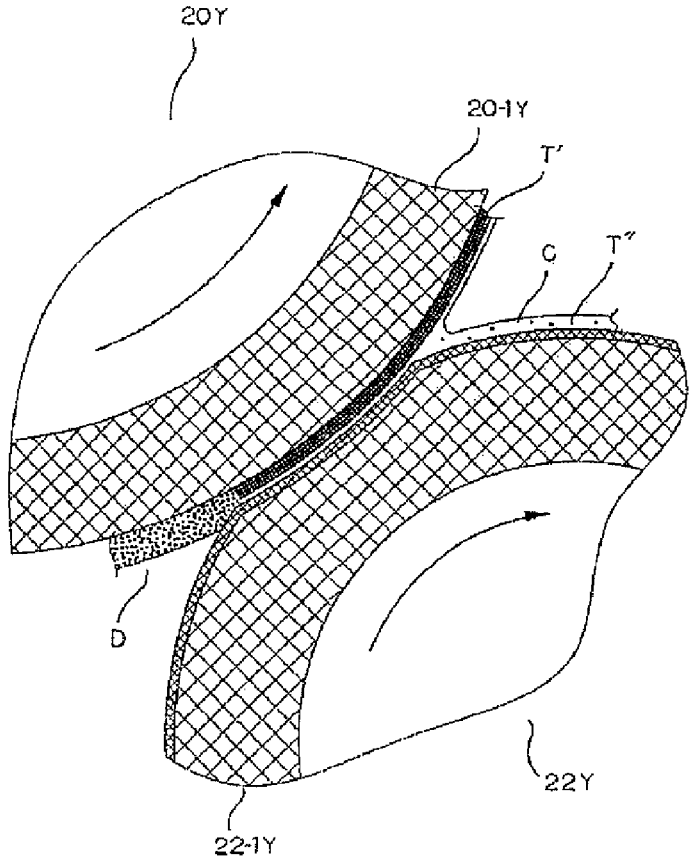
FIG. 4 is a diagram showing compression of developer performed by a developer compressing roller according to an embodiment of the invention.
Figure 5:
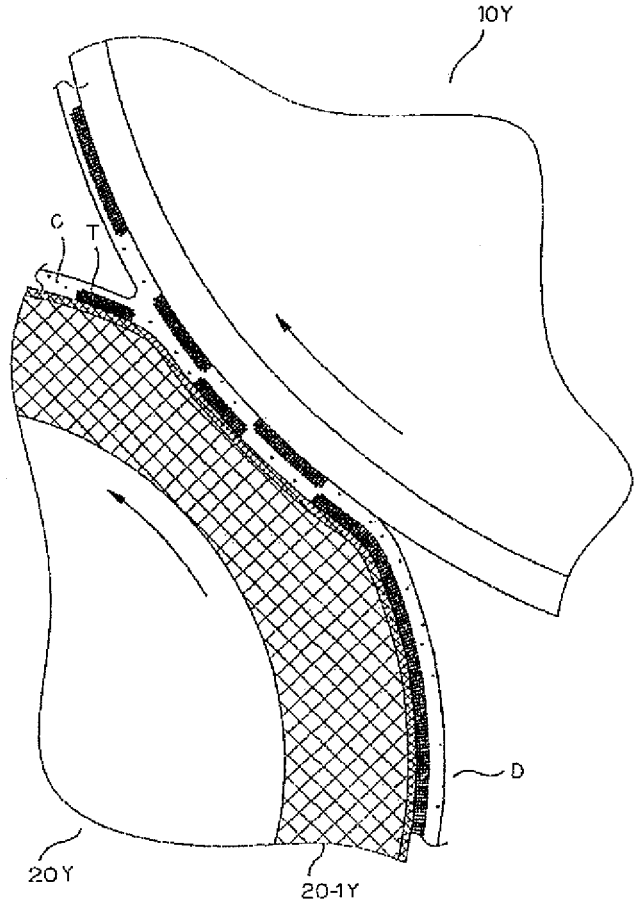
FIG. 5 is a diagram showing a developing process performed by a developing roller according to an embodiment of the invention.
Figure 6:
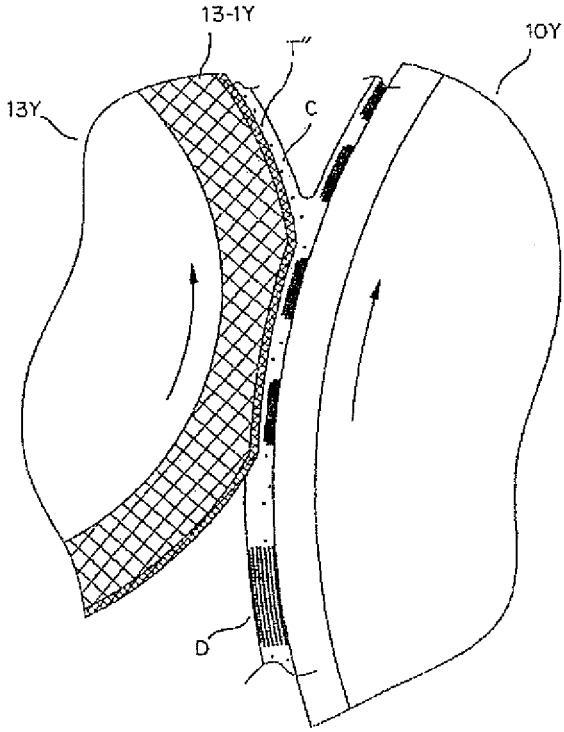
FIG. 6 is a diagram showing a squeezing operation performed by an image carrier squeezing roller according to an embodiment of the invention.

Next, the image forming units and the developing units will be described. FIG. 2 is a cross-section view showing major constituent elements of an image forming unit and a developing unit. FIG. 3 is a diagram showing a developer supplying member. FIG. 4 is a diagram showing compression of the developer performed by the developer compressing roller 22Y. FIG. 5 is a diagram showing a developing process performed by the developing roller 20Y. FIG. 6 is a diagram showing a squeezing operation performed by an image carrier squeezing roller 13Y. Since the configurations of the image forming units and the developing units for each color are the same, hereinafter, an image forming unit of yellow color Y and a developing unit of yellow color Y will be described.

In the image forming unit, a neutralization device 16Y, a cleaning device including an image carrier cleaning blade 17Y and a developer collecting unit 18Y, a corona charging 11Y, an exposure unit 12Y, a developing roller 20Y of the developing unit 30Y, and a squeeze device including an image carrier squeezing roller 13Y and an image carrier squeezing roller cleaning blade 14Y are disposed along the rotation direction of the outer periphery of the image carrier 10Y. In addition, on the outer periphery of the developing roller 20Y of the developing unit 30Y, a cleaning blade 21Y and a developer supplying roller 32Y using an anilox roller are disposed. Inside the liquid developer container 31Y, an agitating paddle 36Y and a developer supplying roller 32Y are housed. In addition, along the intermediate transfer body 40, a primary transfer roller 51Y of the primary transfer unit is disposed in a position facing the image carrier 10Y.

The image carrier 10Y is a photosensitive drum that has a width larger than that of the developer roller 20Y by about 320 mm and is formed of a cylindrical member having a photosensitive layer formed on its outer peripheral surface. For example, the image carrier 10Y, as shown in FIG. 2, is rotated in the clockwise direction. The photosensitive layer of the image carrier 10Y is formed of an organic image carrier, an amorphous silicon image carrier, or the like. The corona charging 11Y is disposed on the upstream side of a nip part of the image carrier 10Y and the developing roller 20Y in the rotation direction of the image carrier 10Y. To the corona charging 10Y, a bias having a same polarity as the charging polarity of developing toner particles is applied by a power supply device not shown in the figure so as to charge the image carrier 10Y. The exposure unit 12Y, on the downstream side of the corona charging 11Y in the rotation direction of the image carrier 10Y, forms an electrostatic latent image on the image carrier 10Y by exposing the upper surface of the image carrier 10Y that is charged by the corona charging 11Y.

The developing unit 30Y has the developer container 31Y that stores liquid developer in a state that toner having a weight ratios of about 25% is dispersed into carrier liquid, the developing roller 20Y that carries the liquid developer, the developer supplying roller 32Y, a regulating blade 33Y, and the agitating paddle 36Y that are used for agitating the liquid developer to be maintained in a same dispersion state and supplying the liquid developer to the developing roller 20Y, a supply unit 35Y that supplies the liquid developer to the agitating paddle 36Y from a liquid developer storing unit 71Y to be described later, the developing roller cleaning blade 21Y that performs a cleaning operation for the developing roller 20Y, and a collecting screw 34Y that collects the liquid developer scraped by the developing roller cleaning blade 21Y and the image carrier squeezing roller cleaning blade 14Y and sends the collected liquid developer to the liquid developer storing unit 71Y, to be described later.

The liquid developer housed in the developer container 31Y is not generally-used volatile liquid developer having low density (about 1 to 2 wt %), low viscosity, and volatile at room temperature and using Isopar (trademark of Exxon) as a carrier liquid, but non-volatile liquid developer having high density, high viscosity, and non-volatile at room temperature. In other words, the liquid developer according to an embodiment of the invention is high-viscosity (about 30 to 10000 mPa·s) liquid developer that is prepared by adding solids having average diameter of 1 μm, in which colorants such as pigments are dispersed in a thermoplastic resin, into a liquid solvent such as an organic solvent, silicon oil, mineral oil, or cooking oil with a dispersant to have a toner solid content of about 25%.

The developer supplying roller 32Y, as shown in FIG. 3, is a cylindrical member and is an anilox roller having a corrugated surface in which delicate spiral grooves are formed so as to easily carry the developer on the surface. For example, the developer supplying roller 32Y is rotated in the clockwise direction as shown in FIG. 2. In regard to the size of the grooves, the pitch of the grooves is about 130 μm, and the depth of the grooves is about 30 μm. The liquid developer is supplied from the developer container 31Y to the developing roller 20Y by the developer supplying roller 32Y. The agitating paddle 36Y and the developer supplying roller 32Y may be brought into contact with each other in a slidable manner or may be disposed to be separated from each other.

The regulating blade 33Y is configured by an elastic blade formed by coating the surface with an elastic body, a rubber part formed of urethane rubber or the like that is brought into contact with the surface of the developer supplying roller 32Y, and a plate formed of metal or the like that supports the rubber part. The regulating blade 33Y controls the amount of the liquid developer supplied to the developing roller 20Y by regulating and controlling the film thickness and amount of the liquid developer that is carried and transported in the developer supplying roller 32Y configured by an anilox roller. The rotation direction of the developer supplying roller 32Y may not be a direction denoted by an arrow shown in FIG. 2 and may be a direction opposite thereto. In such a case, the regulating blade 33Y is needed to be disposed in correspondence with the rotation direction.

The developing roller 20Y is a cylindrical member having a width of about 320 mm and is rotated in the counterclockwise direction as shown in FIG. 2. The developing roller 20Y is configured by forming an elastic layer formed of polyurethane rubber, silicon rubber, NBR, or the like on the outer periphery of an inner core formed of metal such as iron. The developing roller cleaning blade 21Y is formed of rubber that is brought into contact with the surface of the developing roller 20Y. The developing roller 20Y is disposed on the downstream side of a developing nip part that is brought into contact with the image carrier 10Y in the rotation direction of the developing roller 20Y, and the developing roller cleaning blade 21Y scrapes and removes liquid developer remaining in the developing roller 20Y.

The developer compressing roller 22Y is a cylindrical member and, as shown in FIG. 4, similarly to the developing roller 20Y, is in the form of an elastic roller configured by coating an elastic body 22-1Y. The developer compressing roller 22Y has a structure in which a conductive resin layer or a rubber layer is formed on a surface layer of a metal roller base material. For example, the developer compressing roller 22Y is, as shown in FIG. 2, rotated in the clockwise direction that is opposite to the direction of the developing roller 20Y. The developer compressing roller 22Y has a unit for increasing the charging bias of the surface of the developing roller 20Y. The developer that has been transported by the developing roller 20Y, as shown in FIGS. 2 and 4, applies an electric field from the developer compressing roller 22Y side to the developing roller 20Y in a developer compressing part in which the developer compressing roller 22Y is sled to be brought into contact with the developing roller 20Y. The unit for applying the electric field for compressing the developer may be a corona discharger that generates corona discharge instead of the roller shown in FIG. 2.

By the developer compressing roller 22Y, as shown in FIG. 4, toner T uniformly dispersed into the carrier liquid C is moved to be aggregated to the developing roller 20Y side, and then so-called a developer compressing state T' is formed. In addition, a part of the carrier liquid C and a small amount of toner T" that is not in the developer compressing state are carried and rotated in a direction denoted by an arrow shown in the figure by the developer compressing roller 22Y, are scraped to be removed by the developer compressing roller cleaning blade 23Y, and are merged with the developer inside the developer container 31Y to be reused. On the other hand, the developer D that is carried in the developing roller 20Y to be developer-compressed is, as shown in FIG. 5, in a developing nip part in which the developing roller 20Y is brought into contact with the image carrier 10Y, developed in correspondence with the latent image of the image carrier 10Y by application of a required electric field. Then, the remaining developer D after development is scraped to be removed by the developing roller cleaning blade 21Y and is merged with the developer inside the developer container 31Y to be reused. The merged carrier liquid and toner are not in a state of a mixed color.

The image carrier squeezing device is disposed on the downstream side of the developing roller 20Y to face the image carrier 10Y and collects remaining developer in the image carrier 10Y after development of a toner image. As shown in FIG. 2, the image carrier squeezing device includes the image carrier squeezing roller 13Y formed of an elastic roller member that has the surface coated with an elastic body 13*a*Y and is sled to be brought into contact with the image carrier 10Y for being rotated and the cleaning blade 14Y that is sled to be brought into contact with the image carrier squeezing roller 13Y in a pressing manner so as to clean the surface.

The primary transfer unit SOY transfers a developer image developed on the image carrier 10Y on the intermediate transfer body 40 by using the primary transfer roller 51Y. Here, a configuration in which the image carrier 10Y and the intermediate transfer body 40 are moved at a constant speed is used. Accordingly, driving load for rotation and movement is reduced, and disturbance of the developed toner image due to the image carrier 10Y is suppressed.

The developer collecting and supplying device 70Y has the liquid developer storing unit 71Y that stores the collected liquid developer and controls density of the liquid developer by supplying high-density developer from a developer tank 74Y and a carrier liquid from a carrier liquid tank 77Y.

In this embodiment, the liquid developer is collected from the developing unit 30Y and the image carrier 10Y. The liquid developer collected by the developer collecting screw 34Y of the developing unit 30Y is collected into the liquid developer storing unit 71Y through a developing unit collecting path 72Y. In addition, the liquid developer collected by the cleaning device that is configured by the image carrier cleaning blade 17Y and the developer collecting unit 18Y from the image carrier 10Y is collected into the liquid developer storing unit 71Y through a carrier collecting path 73Y.

In addition, the high-density developer is supplied from the developer tank 74Y to the liquid developer storing unit 71Y through a developer supplying path 75 and a developer pump 76. The carrier liquid is supplied from the carrier liquid tank 77Y to the liquid developer storing unit 71Y through a carrier liquid supplying path 78Y and a carrier liquid pump 79Y. A structure in which the developer or the carrier liquid is supplied by opening or closing a valve or the like using gravity instead of the pump and the like may be used.

The liquid developer stored in the liquid developer storing unit 71Y is supplied to the developer container 31Y through a developer supplying path 81Y and a developer supplying pump 82Y.

Next, the operation of the image forming apparatus according to an embodiment of the invention will be described. Subsequently, in regard of the image forming units and the developing units, the image forming unit of yellow color and the developing unit 30Y from among the four image forming units and the developing units will be described as examples.

In the developer container 31Y, toner particles in the liquid developer have positive charges. The liquid developer is pumped from the developer container 31Y by agitating the liquid developer by using the agitating paddle 36Y to rotate the developer supplying roller 32Y.

The regulating blade 33Y is brought into contact with the surface of the developer supplying roller 32Y, leaves liquid developer inside the anilox-patterned grooves that are formed on the corrugated surface of the developer supplying roller 32Y, and scrapes other remaining liquid developer. Accordingly, the regulating blade 33Y regulates the amount of liquid developer to be supplied to the developing roller 20Y. By the above-described regulating operation, the film thickness of liquid developer coated on the developing roller 20Y is quantified to be about 6 μm. Then, the liquid developer scraped by the regulating blade 33Y is fallen to be returned to the developer container 31Y by gravity. On the other hand, liquid developer that has not been scraped by the regulating blade 33Y is stored in the grooves of corrugated surface of the developer supplying roller 32Y and is pressed by the developing roller 20Y, and accordingly, the liquid developer is coated on the surface of the developing roller 20Y.

The developing roller 20Y on which the liquid developer is coated by the developer supplying roller 32Y is brought into contact with the developer compressing roller 22Y on the downstream of a nip part between the developer supplying roller 32Y and the developing roller 20Y. To the developing roller 20Y, a bias of about +400 V is applied. In addition, to the developer compressing roller 22Y, a bias that is higher than that of the developing roller 20Y and has a same polarity as the charging polarity of the toner is applied. For example, to the developer compressing roller 22Y, a bias of about +600 V is applied. Accordingly, toner particles in the liquid developer on the developing roller 20Y, as shown in FIG. 4, are moved to the developing roller 20Y side at the moment when the toner particles pass the nip between the developer compressing roller 22Y and the developing roller 20Y. Accordingly, a state that the toner particles are gently combined together and formed as a film is formed. Thus, in a developing process at the image carrier 10Y, the toner particles are moved from the developing roller 20Y to the image carrier 10Y in a prompt manner, and thereby the image density is improved.

The image carrier 10Y is formed of amorphous silicon. After the surface of the image carrier 10Y is charged at about +600 V by the corona charging 11Y on the upstream of a nip part between the developing roller 20Y and the image carrier 10Y, a latent image is formed on the image carrier 10Y, so that the electric potential of the image part is set to +25 V by the exposure unit 12Y. In the developing nip part formed between the developing roller 20Y and the image carrier 10Y, as shown in FIG. 5, the toner particles T are selectively moved to the image part on the image carrier 10Y in accordance with an electric field formed by the bias of +400 V applied to the image carrier 20Y and the latent image (image part+25 V, non-image part+600 V) on the image carrier 10Y, and thereby a toner image is formed on the image carrier 10Y. In addition, since the carrier liquid C is not influenced by the electric field, as shown in FIG. 5, the carrier liquid is divided at the outlet of the developing nip part of the developing roller 20Y and the image carrier 10Y, and thus, the carrier liquid is adhered to both the developing roller 20Y and the image carrier 10Y.

The image carrier 10Y passing through the developing nip part passes though the image carrier squeezing roller 13Y part. The image carrier squeezing roller 13Y, as shown in FIG. 6, has a function for increasing the toner particle ratio of a developed image by collecting the remaining carrier liquid C from the developer D developed on the image carrier 10Y and originally unnecessary redundant toner T". The capability of collecting the remaining carrier liquid C can be set to a required level by using the rotation direction of the image carrier squeezing roller 13Y and a relative difference of the circumferential velocity of the surface of the image carrier squeezing roller 13Y with respect to the circumferential velocity of the surface of the image carrier 10Y. When the image carrier squeezing roller 13Y is rotated in a counter direction with respect to the image carrier 10Y, the collection capability increases. In addition, as the above-described difference between the circumferential velocities is set to be large, the collection capability increases, and thus, an additional synergetic effect can be acquired.

In this embodiment, as an example, the image carrier squeezing roller 13Y is rotated at an approximately same circumferential velocity as that of the image carrier 10Y as shown in FIG. 6 and a redundant carrier liquid C having a weight ratio of about 5 to 10% is collected from the developer D developed on the image carrier 10Y. Accordingly, both loads for driving rotation are reduced, and disturbance of the developed toner image due to the image carrier 10Y is suppressed. The redundant carrier liquid C and the unnecessary redundant toner T" that have been collected by the image carrier squeezing roller 13Y are collected from the image carrier squeezing roller 13Y into the developer container 31Y by the operation of the cleaning blade 14Y. In addition, since the redundant carrier liquid C and the redundant toner T' collected as described above are collected from an isolated dedicated image carrier 10Y, a phenomenon of color mixture does not occur in all the spots.

Next, the image carrier 10Y passes the nip part between the intermediate transfer body 40 and the image carrier 10Y, so that the primary transfer of the developed toner image onto the intermediate transfer body 40 is performed by the primary transfer unit 10Y. To the primary transfer roller 51Y, about −200 V having a polarity opposite to that of the charged polarity of the toner particles is applied, and accordingly the toner is primary transferred onto the intermediate transfer body 40 from the image carrier 10Y, and only the carrier liquid remains in the image carrier 10Y. On the downstream side of the primary transfer unit in the rotation direction of the image carrier 10Y, the electrostatic latent image is eliminated from the image carrier 10Y after the primary transfer by the neutralization device 16Y formed of LEDs or the like. Then, the remaining carrier liquid on the image carrier 10Y is scraped off by the image carrier cleaning blade 17Y and is collected to the developer collecting unit 18Y.

The toner image formed on the intermediate transfer body 40 which is carried in a superposing manner by primary transforming toner images formed on a plurality of image carriers 10 one after another advances to the secondary transfer unit 60 and enters into the nip part between the intermediate transfer body 40 and the secondary transfer roller 61. The width of the nip part is set to 3 mm. In the secondary transfer unit 60, −1200 V is applied to the secondary roller 61, and +200 V is applied to the belt driving roller 41. Accordingly, the toner image on the intermediate transfer body 40 is transferred onto a recording medium (sheet member) such as a paper sheet.

However, when a trouble in supplying the sheet member such as a jam occurs, not all the toner images are transferred onto the secondary transfer roll to be collected, and a part of the toner images remains on the intermediate transfer body. In addition, in an ordinary secondary transfer process, not 100% of the toner image formed on the intermediate transfer body is secondary transferred to be transited onto the sheet member, and several percentages of secondary transfer remaining occurs. In particular, when a trouble in supplying the sheet member such as a jam occurs, the toner image is brought into contact with the secondary transfer roller 61 to be transferred in a state that the sheet member is not interposed therebetween, and thus the rear surface of the sheet member gets dirty. In a process not for transferring the unnecessary toner images, in this embodiment, a bias that is in the direction for pressing the toner particles of the liquid developer to the intermediate transfer body and has a same polarity as the charged polarity of the toner particles is applied to the secondary transfer roller 61. Accordingly, the toner particles of the liquid developer remaining on the intermediate transfer body 40 is pressed to the intermediate transfer body 40 side to be in a compaction state, and the carrier liquid is collected (squeezed) at the secondary transfer roller 61 side. Then a cleaning operation for the surface of the intermediate transfer body 40 is performed by using the intermediate transfer body cleaning blade 46, and a cleaning operation for the surface of the secondary transfer roller 61 is performed by using the secondary roller cleaning blade 62.

Next, the cleaning device of the intermediate transfer body 40 will be described. When a trouble in supplying the sheet member such as a jam occurs, not all the toner images are transferred onto the secondary transfer roller 61 to be collected, and thus, a part of the toner images remains on the intermediate transfer body 40. In addition, in an ordinary secondary transfer process, not 100% of the toner image formed on the intermediate transfer body 40 is secondary transferred to be transited onto the sheet member, and a several percent of secondary transfer remaining occurs. These two types of the unnecessary toner images are collected by the intermediate transfer body cleaning blade 46 and the developer collecting unit 47 that are disposed to be brought into contact with the intermediate transfer body 40 for forming the next image. In such a non-transfer process, a bias for pressing the remaining toner on the intermediate transfer body 40 to the intermediate transfer body 40 is applied to the secondary transfer roller 61.

Next, a density measuring device 120Y will be described. As shown in FIG. 2, the density measuring device 120Y has an agitating propeller shaft 121Y, a transparent propeller 122Y as an example of a moving member, an agitating propeller 123Y as an example of an agitating member, a motor 124Y, and a density measuring unit 130Y.

The transparent propeller 122Y and the agitating propeller 123Y are disposed in a same shaft that is the agitating propeller shaft 121Y, and the agitating propeller shaft 121Y is a member that is rotated by the motor 124Y.

Figure 7:
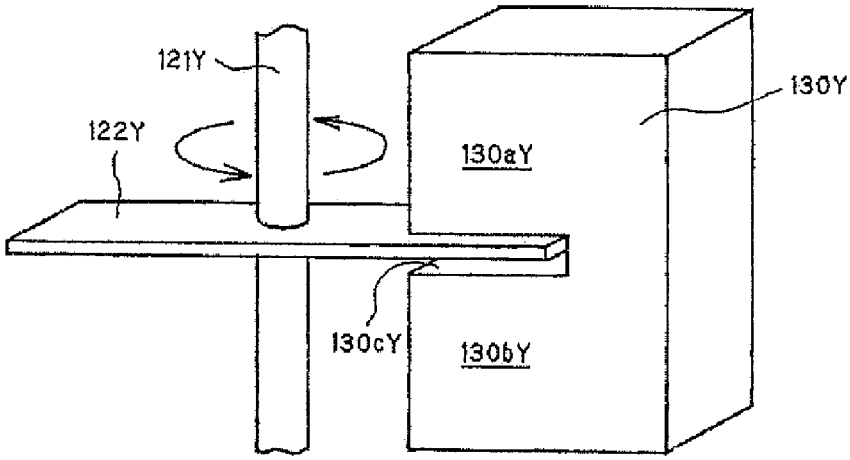
FIG. 7 is an enlarged view of a part in the vicinity of a transparent propeller shown in FIG. 2.
Figure 8A:
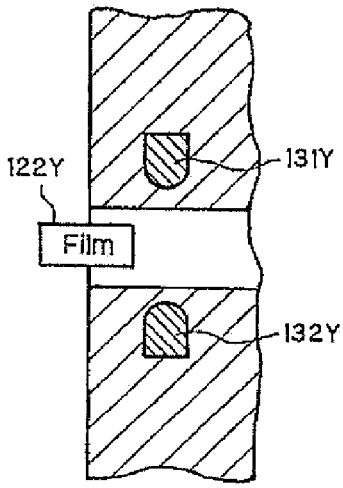
FIGS. 8A and 8B are enlarged views of a gap according to an embodiment of the invention.
Figure 8B:
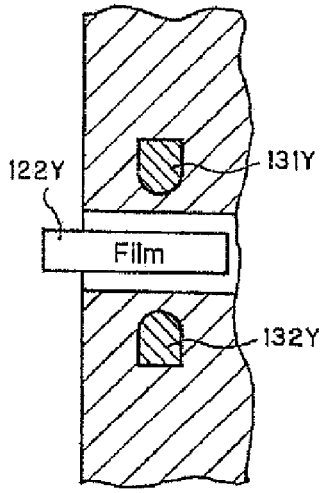
Figure 9:
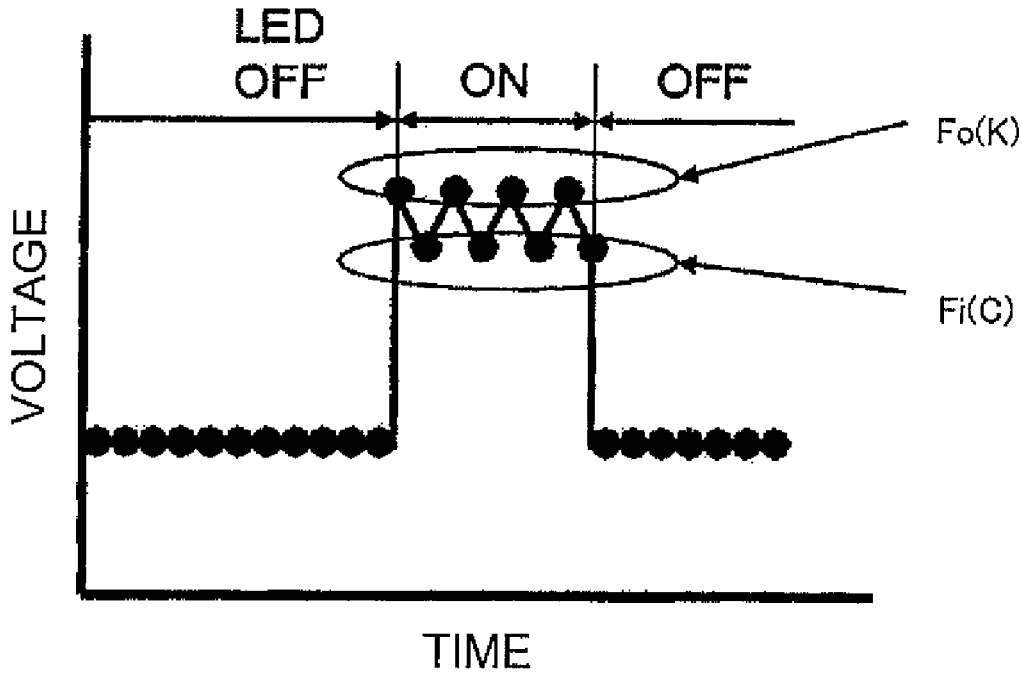
FIG. 9 is a diagram showing a change of a signal output from a density-measuring light receiving element according to an embodiment of the invention.
Figure 10A:
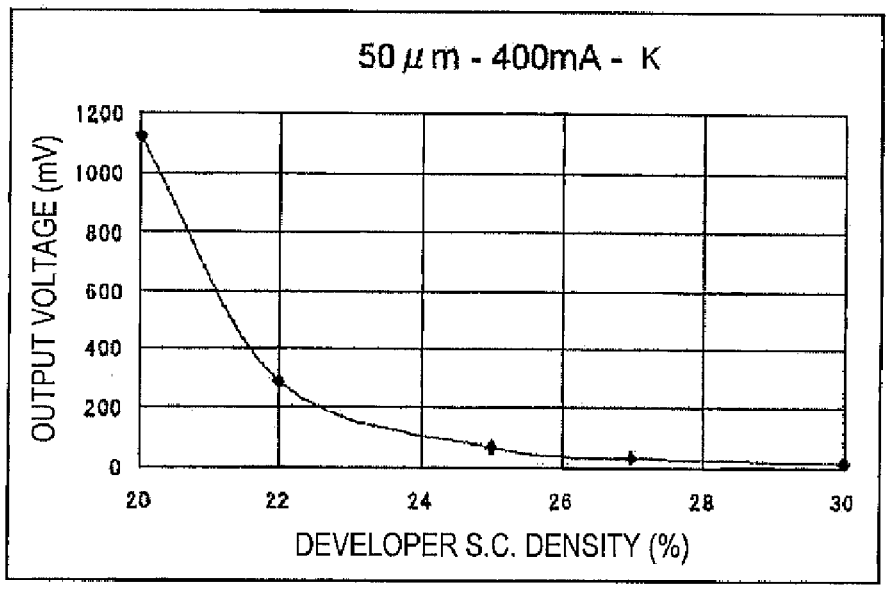
FIGS. 10A and 10B are graphs showing a relationship between output voltage of the density-measuring light receiving element and the density of liquid developer according to an embodiment of the invention.
Figure 10B:
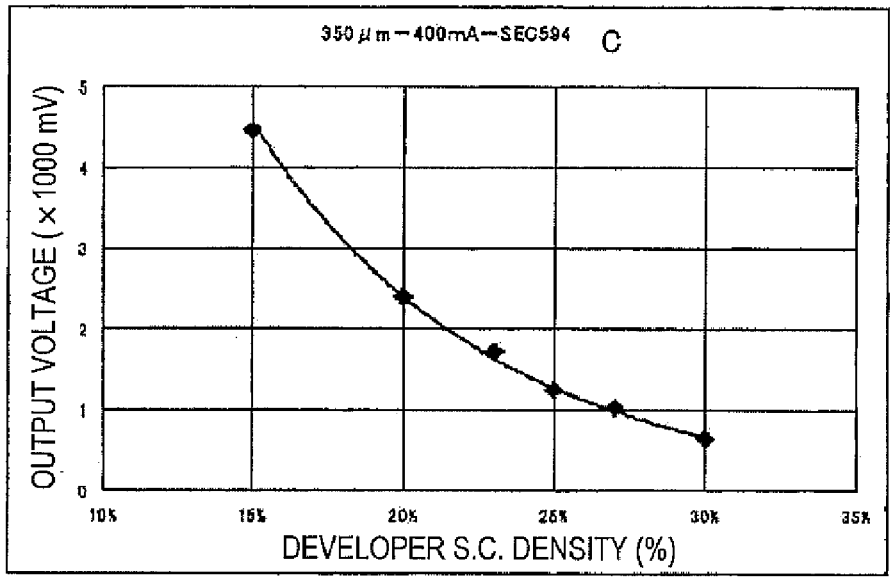
Figure 11:
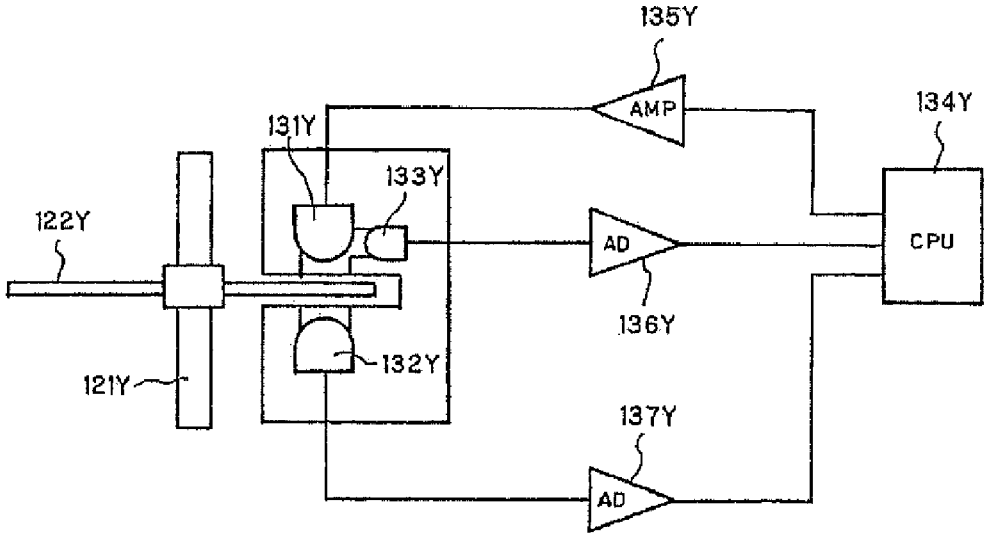
FIG. 11 is a system diagram of a transmission-type density measuring unit according to an embodiment of the invention.
Figure 12:
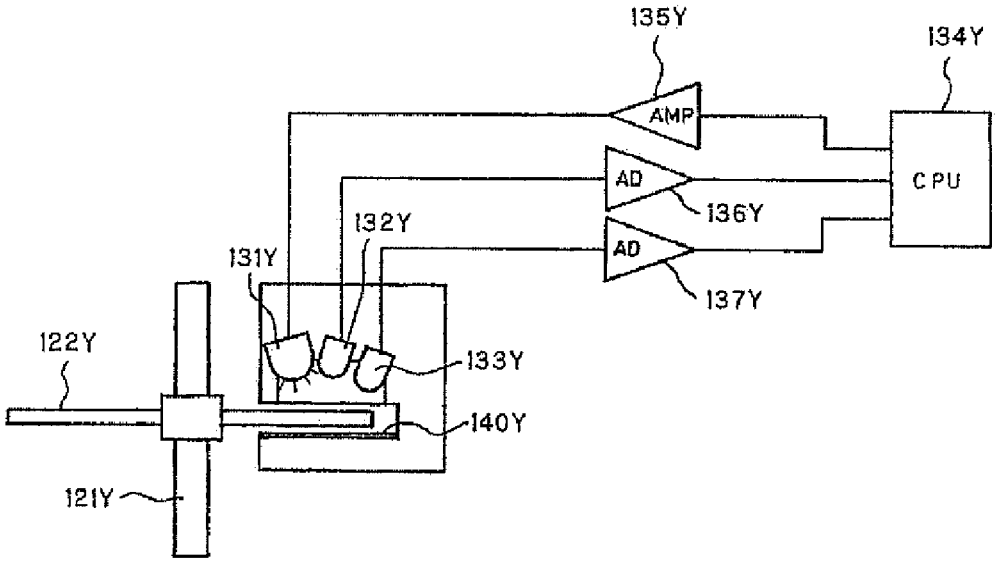
FIG. 12 is a system diagram of a reflection-type density measuring unit according to an embodiment of the invention.

Next, a density detecting method by using the density measuring unit 130Y and the transparent propeller 122Y will be described. FIG. 7 is an enlarged view of a part in the vicinity of the transparent propeller 122Y shown in FIG. 2. FIGS. 8A and 8B are enlarged views of a gap. FIG. 9 is a diagram showing a change of a signal output from a density-measuring light receiving element 132Y. FIGS. 10A and 10B are graphs showing a relationship between the output voltage of the density-measuring light receiving element 132Y and the density of liquid developer. FIG. 11 is a system diagram of a transmission-type density measuring unit 130Y. FIG. 12 is a system diagram of a reflection-type density measuring unit 130Y.

As shown in FIG. 7, the transparent propeller 122Y is supported by the agitating propeller shaft 121Y and is formed of a member having a flat plate shape such as a rectangle that can be rotatable. The transparent propeller 122Y has a structure for intermittently passing a gap 130*c*Y between first and second members 130*a*Y and 130*b*Y of the density measuring unit 130Y. The first member 130*a*Y or the second member 130*b*Y can be moved, and thus a distance of the gap 130*c*Y can be changed. The distance of the gap 130*c*Y may be changed in accordance with the color of the liquid developer.

Next, a simple principle of the density detecting method will be described. FIGS. 8A and 8B are enlarged views of the gap. FIG. 9 is a diagram showing a change of a signal output from the density-measuring light receiving element 132Y. As shown in FIG. 8A, when the transparent propeller 122Y is not positioned between a light emitting diode (LED) 131 and the density-measuring light receiving element 132Y, the density-measuring light receiving element 132Y outputs a signal having a smaller value Fo between graphs shown in FIG. 9. As shown in FIG. 8B, when the transparent propeller 122Y is positioned between the light emitting diode (LED) 131 and the density-measuring light receiving element 132Y, the density-measuring light receiving element 132Y outputs a signal having a larger value Fi between graphs shown in FIG. 9. In this embodiment, a value for acquiring a density value is selected for each color. For example, for black, a density value is acquired by averaging values Fi, and for cyan, a density value is acquired by averaging values Fo.

FIGS. 10A and 10B are graphs showing a relationship between the output voltage of the density-measuring light receiving element 132Y and the density of liquid developer. FIG. 10A shows a relationship between the output voltage of the density-measuring light receiving element 132Y and the density of liquid developer for black. In addition, FIG. 10B shows a relationship between the output voltage of the density-measuring light receiving element 132Y and the density of liquid developer for cyan.

In the transmission-type density measuring unit 130Y as shown in FIG. 11, a light emitting diode (LED) 131Y and the density-measuring light receiving element 132Y are disposed to face each other with a gap 130*c*Y interposed therebetween. On the light emitting diode (LED) 131Y side, an emission intensity-measuring light receiving element 133Y as a second light receiving element 133Y is disposed.

Under such a structure, light emitted from the light emitting diode (LED) 131Y has a light path formed though liquid developer on the light emitting diode (LED) 131Y side relative to the transparent propeller 122Y, the transparent propeller 122Y, and liquid developer on the density-measuring light receiving element 132Y side relative to the transparent propeller 122Y to the density-measuring light receiving element 132Y and a light path formed through the liquid developer on the light emitting diode (LED) 131Y side relative to the transparent propeller 122Y to the emission intensity-measuring light receiving element 133Y.

The light emitting diode (LED) 131Y, the density-measuring light receiving element 132Y and the emission intensity-measuring light receiving element 133Y are connected to a CPU 134Y. The light emitting diode (LED) 131Y is connected to the CPU 134Y through an amplifier 135Y. In addition, the density-measuring light receiving element 132Y is connected to the CPU 134Y through a first A/D converter 136Y. The emission intensity-measuring light receiving element 133Y is connected to the CPU 134Y through a second A/D converter 137.

In the reflection-type density measuring unit 130Y as shown in FIG. 12, on one side of a gap 130*c*Y, the light emitting diode (LED) 131Y, the density-measuring light receiving element 132Y, and the emission intensity-measuring light receiving element 133Y are disposed. In addition, on the other side of the gap 130*c*Y, a reflective film 140Y is disposed.

Under such a structure, light emitted from the light emitting diode (LED) 131Y has a light path formed though liquid developer on the light emitting diode (LED) 131Y side relative to the transparent propeller 122Y, the transparent propeller 122Y, and liquid developer on the reflective film 140Y side, reflected from the reflective film 140Y, and then through liquid developer on the reflective film 140Y side, the transparent propeller 122Y, liquid developer on the density-measuring light receiving element 132Y side relative to the transparent propeller 122Y to the density-measuring light receiving element 132Y and a light path formed through the liquid developer on the light emitting diode (LED) 131Y side relative to the transparent propeller 122Y to the emission intensity-measuring light receiving element 133Y.

The light emitting diode (LED) 131Y, the density-measuring light receiving element 132Y and the emission intensity-measuring light receiving element 133Y are connected to the CPU 134Y. The light emitting diode (LED) 131Y is connected to the CPU 134Y through an amplifier 135Y. In addition, the density-measuring light receiving element 132Y is connected to the CPU 134Y through a first A/D converter 153Y. The emission intensity-measuring light receiving element 133Y is connected to the CPU 134Y through a second A/D converter 137Y.

Figure 13:
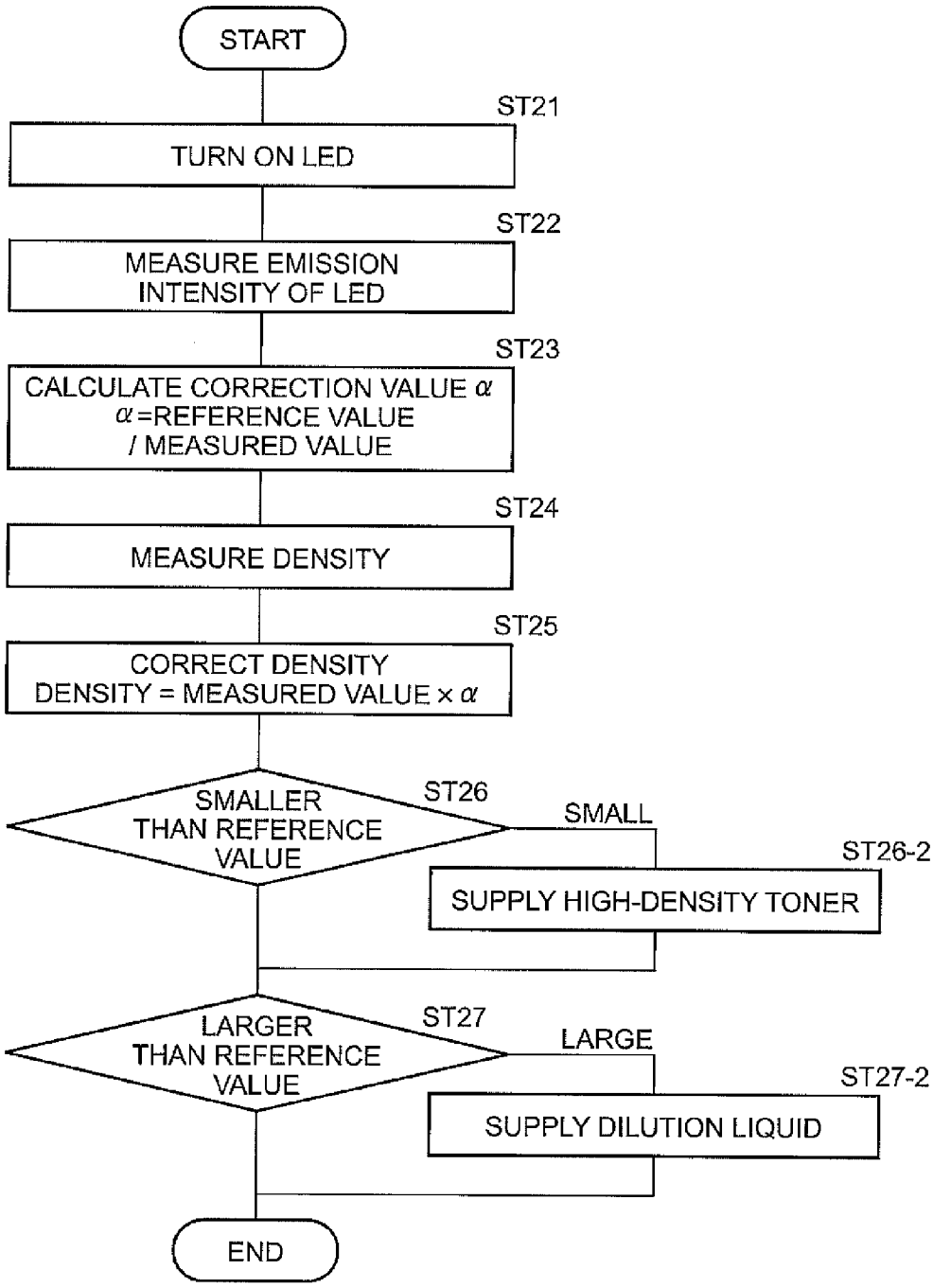
FIG. 13 is a flowchart of a detection process of a density measuring unit according to an embodiment of the invention.

Next, a detection method using the above-described density measuring device 120Y will be described. FIG. 13 is a flowchart of a detection process of the density measuring device 120Y.

First, in Step 21, the light emitting diode (LED) 131Y is turned on (ST21). Subsequently, in Step 22, the light intensity of the light emitting diode (LED) 131Y is measured by using the emission intensity-measuring light receiving element 133Y (ST22).

Next, in Step 23, a correction value $\alpha$ is calculated (ST23). The correction value $\alpha$ is acquired by comparing a measured value measured by the emission intensity-measuring light receiving element 133Y with a reference value of the light emitting diode (LED) 131Y.

Next, In Step 24, the density is measured by using the density-measuring light receiving element 132Y (ST24).

Figure 14:
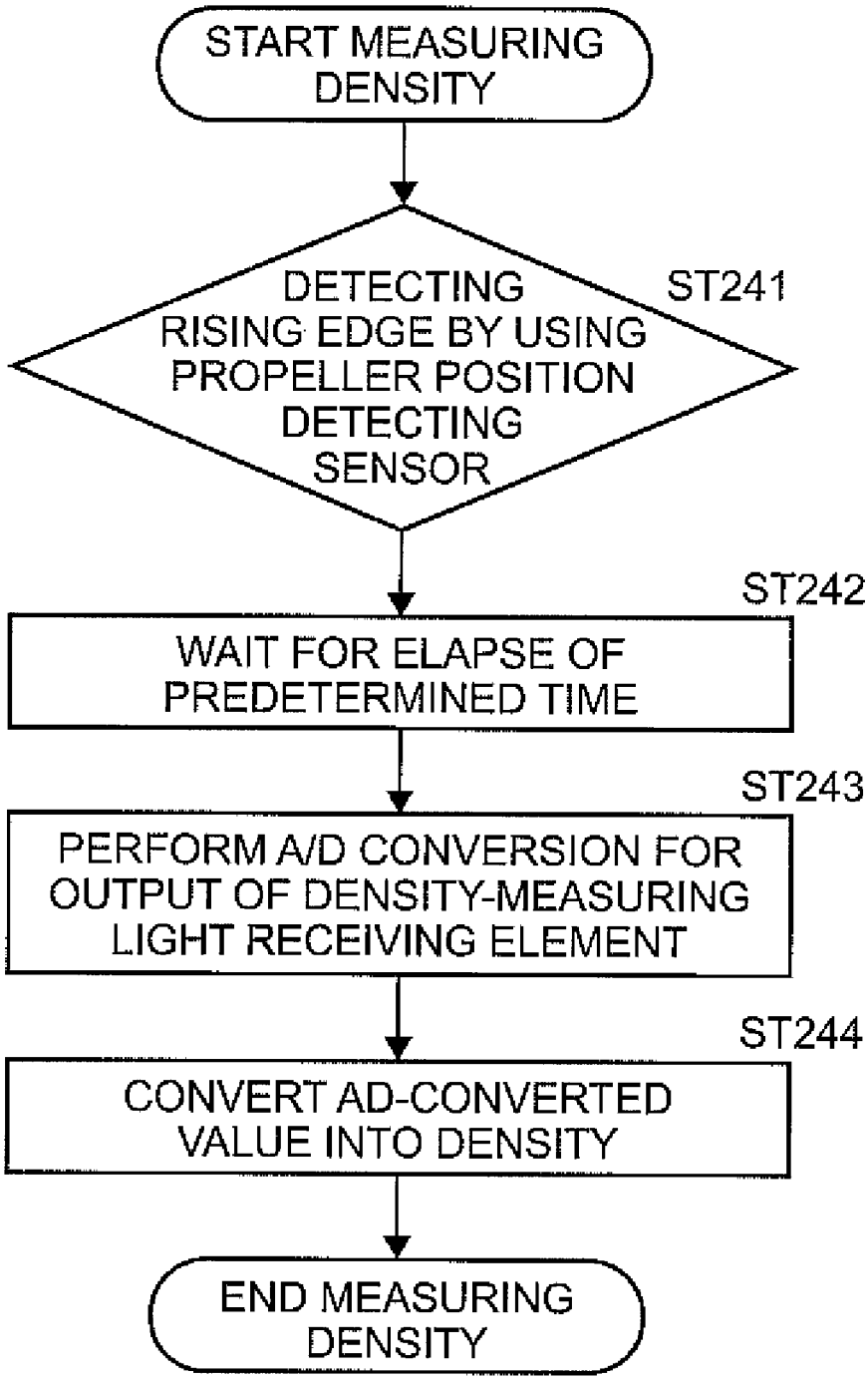
FIG. 14 is a diagram showing a flowchart of a density measuring process according to an embodiment of the invention.

Here, the method of measuring density in Step 24 will be described. FIG. 14 is a flowchart showing the process of Step 24 in detail. When a density measuring process is started, first, a transparent propeller position-detecting device detects whether the position of the transparent propeller 122Y is in a rising edge in Step 241 (ST241).

When the position of the transparent propeller 122Y is not in a rising edge in Step 241, the process proceeds back to Step 241. On the other hand, when the position of the transparent propeller 122Y is in the rising edge in Step 241, elapse of a predetermined time is waited in Step 242 (ST242). Here, the predetermined time is a time required for the transparent propeller 122Y to reach a desired position. When the liquid developer of C, M, and Y is used, the desired position is a position in which the transparent propeller 122Y is taken off the light path of the light emitting diode (LED) 131Y of the density measuring device 130Y and the density-measuring light receiving element 132Y. When the liquid developer is K, the desired position is a position in which the transparent propeller 122Y is positioned within the light path of the light emitting diode (LED) 131Y of the density measuring device 130Y and the density-measuring light receiving element 132Y.

Subsequently in Step 243, an AD conversion process is performed for the output of the density-measuring light receiving element 132Y (ST243). Next, in Step 244, the AD-converted value is converted into a density value (ST244) Here, for the conversion process, a table method in which a correspondence relationship is stored in advance, a method in which a density value is acquired by performing proportional calculation using two normal points having a measured point interposed therebetween, or the like is used.

Subsequently, in Step 25, the density of the liquid developer is acquired by performing density correction by using the CPU 134Y (ST25). The density of the liquid developer is acquired by multiplying the measured value that has been measured by the density-measuring light receiving element 132Y in Step 24 by the correction value $\alpha$ acquired in Step 23.

Next, in Step 26, it is determined whether the density of the liquid developer is smaller than a density reference value stored in advance (ST26). When the density of the liquid developer is determined to be smaller than the density reference value, in Step 26-2, high-density developer is supplied from the developer tank 74Y to the liquid developer storing unit 71Y through a developer supplying path 75Y and a developer pump 76Y (ST26-2).

On the other hand, when the density of the liquid developer is determined not to be smaller than the density reference value in Step 26, it is determined whether the density of the liquid developer is larger than the density reference value stored in advance in Step 27 (ST27). When the density of the liquid developer is determined to be larger than the density reference value, in Step 27-2, the carrier liquid is supplied from the carrier liquid tank 77Y to the liquid developer storing unit 71Y though the carrier liquid supplying path 78Y and the carrier liquid pump 79Y (ST27-2).

As described above, according to an embodiment of the invention, the first member 130*a*Y that is disposed on one side of sides facing each other with the gap 130*c*Y interposed therebetween, the second member 130*b*Y disposed on the other side to face the first member 130*a*Y, the density measuring unit 130Y disposed to face the gap 130*c*Y, and the transparent propeller 122Y moving inside the gap 130*c*Y are included. In addition, the density of the liquid located in the gap 130*c*Y for a case where the transparent propeller 122Y is inserted into the gap 130*c*Y is detected. Accordingly, the liquid is not needed to be pumped by using a pump or the like, and thus the number of components decreases. In addition, since the transparent propeller 122Y is moved in the gap 130*c*Y, a new liquid can come into the gap 130*c*Y, and accordingly, the density can be measured accurately.

In addition, the density of the liquid located inside the gap 130*c*Y for a case where the transparent propeller 122Y is not inserted into the gap 130*c*Y is additionally measured, and the measured density is used together with the density of the liquid located inside the gap 130*c*Y for a case where the transparent propeller 122Y is inserted into the gap 130*c*Y for calculating the density. Accordingly, more accurate density can be measured.

In addition, the density measuring members 131Y and 132Y has the light emitting diode (LED) 131Y and the density-measuring light receiving element 132Y, the transparent propeller 122Y has optical transparency, and the density-measuring light receiving element 132Y receives light emitted from the light emitting diode (LED) 131Y through the transparent propeller 122Y. Accordingly, the density can be measured more accurately.

In addition, the density measuring members 131Y and 132Y includes the emission intensity-measuring light receiving element 133Y, and the emission intensity-measuring light receiving element 133Y receives light emitted by the light emitting diode (LED) 131Y not through the transparent propeller 122Y, and accordingly, abnormality such as deterioration of the light emitting diode (LED) 131Y can be detected.

In addition, an image forming method according to an embodiment of the invention includes: a developer container 31Y that stores the liquid developer acquired from dispersing toner particles formed of a colorant and a resin into a carrier liquid, a developing roller 20Y that carries the liquid developer, a developer supplying roller 32Y that supplies the liquid developer to the developing roller 20Y, an agitating paddle 36Y that is disposed inside the developer container 31Y and supplies the liquid developer to the developer supplying roller 32Y, a developing roller cleaning member 21Y that cleans the liquid developer on the developing roller 20Y, an image carrier 10Y on which a latent image is developed by the developing roller 20Y, an intermediate transfer body 40 that forms an image by transferring the image formed on the image carrier 10Y, and a developer collecting and supplying device 70 that collects the liquid developer from the developer container 31Y and supplies the liquid developer and the carrier liquid. In addition, in the above-described method, the number of revolutions of the developer supplying roller 32Y is controlled in accordance with the density of the liquid developer which is acquired from the above-described method of measuring the density. Accordingly, an image having excellent image quality can be formed regardless of the density of the liquid developer.

In addition, an image forming method according to an embodiment of the invention includes: a developer container 31Y that stores the liquid developer acquired from dispersing toner particles formed of a colorant and a resin into a carrier liquid, a developing roller 20Y that carries the liquid developer, a developer supplying roller 32Y that supplies the liquid developer to the developing roller 20Y, an agitating paddle 36Y that is disposed inside the developer container 31Y and supplies the liquid developer to the developer supplying roller 32Y, a developing roller cleaning member 21Y that cleans the liquid developer on the developing roller 20Y, an image carrier 10Y on which a latent image is developed by the developing roller 20Y, an intermediate transfer body 40 that forms an image by transferring the image formed on the image carrier 10Y, a developer collecting and supplying device 70 that collects the liquid developer from the developer container 31Y and supplies the liquid developer and the carrier liquid, and a developer compressing roller 22Y that moves the toner of the liquid developer to be aggregated in the developer roller 20Y. In addition, in the above-described method, the bias of the developer compressing roller 22Y is controlled in accordance with the density of the liquid developer which is acquired from the above-described method of measuring the density. Accordingly, an image having excellent image quality can be formed regardless of the density of the liquid developer.

In addition, since the distance of the gap 130*c*Y is changed for each color of the liquid developer, the density for each color can be adjusted precisely.

Figure 15:
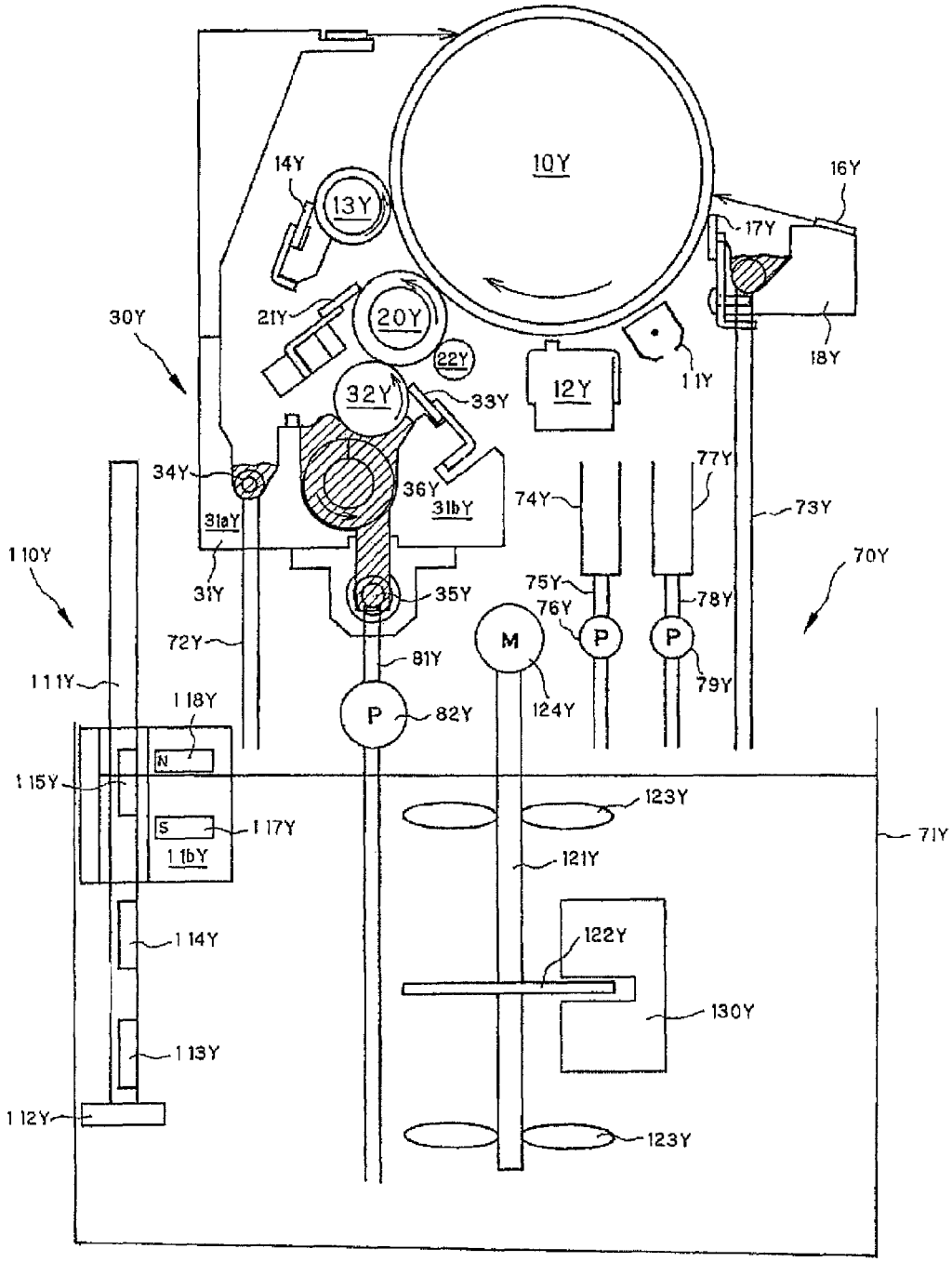
FIG. 15 is a diagram showing a liquid-level detecting unit and a density detecting unit according to an embodiment of the invention.

In addition, as another embodiment, a liquid measuring device 110Y as shown in FIG. 15 may be provided.

Next, the liquid measuring device 110Y will be described. As shown in FIG. 15, the liquid measuring device 110Y has a float supporting member 111Y, a regulating member 112Y, a first hole element 113Y, a second hole element 114Y, a third hole element 115Y, a float 116Y as an example of a floating member, and first and second magnetic field generators 117Y and 118Y.

The float supporting member 111Y is formed of a member that supports the float 116Y to be movable from a position on the liquid surface inside the liquid developer storing unit 71Y to an approximate bottom part below the liquid surface. On the upper side of the float supporting member 111Y, an upper regulating member 112*a*Y is disposed, and a lower regulating member 112*b*Y is disposed on the lower side of the float supporting member. In addition, between the lower regulating member and the upper regulating member, the first hole element 113Y, the second hole element 114Y, and the third hole element 115Y are sequentially disposed from the bottom with a predetermined distance apart therebetween.

The first hole element 113Y, the second hole element 114Y, and the third hole element 115Y are formed of proportional output-type hole members of which output voltage changes in accordance with magnetic flux density. In this embodiment, the distance between the hole elements is set to 30 mm.

The float 116Y is a member that is movable relative to the float supporting member 111Y by floating on the liquid surface in accordance with the position of the liquid surface. On the lower side of the float 116Y, the first magnetic field generator 117Y is disposed, and the second magnetic field generator 118Y is disposed on the upper side thereof to be a predetermined distance apart from the first magnetic field generator 117Y.

The first magnetic field generator 117Y and the second magnetic field generator 118Y are disposed to be moved in accordance with movement of the float 116Y with facing the hole elements 113Y, 114Y, and 115Y. The first magnetic field generator 117Y and the second magnetic field generator 118Y are disposed to have the north (N) pole and the south (S) pole disposed on opposite sides. In this embodiment, the magnetic field generators 117Y and 118Y having a diameter of 5 mm, a length of 6 mm, and 4000 Gauss are disposed to be spaced apart by 20 mm.

Hereinafter, a method of converting outputs of the hole elements 113Y, 114Y, and 115Y into distances in a case where the above-described liquid measuring device 110Y is actually operated will be described.

Figure 16C:
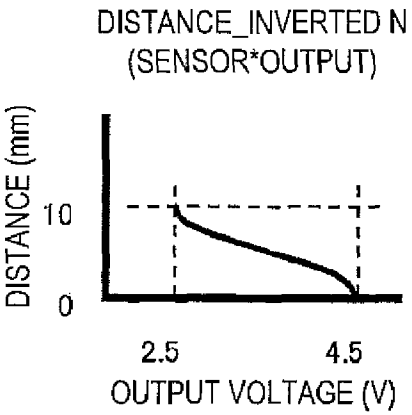
FIGS. 16A, 16B, and 16C are diagrams showing tables used for converting outputs of hole elements into distances according to an embodiment of the invention.
Figure 16B:
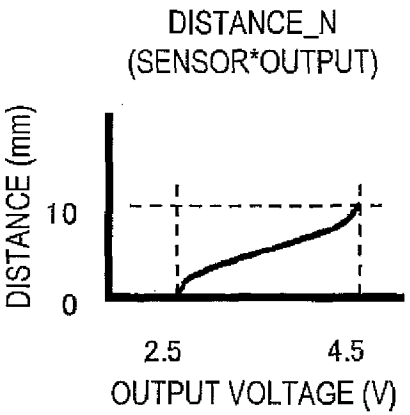
Figure 16A:
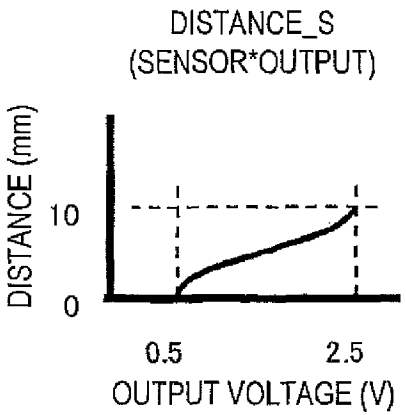

FIGS. 16A, 16B, and 16C are diagrams showing tables used for converting outputs of the hole elements 113Y, 114Y, and 115Y into distances. FIG. 16A is a first table showing a relationship between the output voltage of each hole element and a distance in a case where the south (S) pole is detected. FIG. 16B is a second table showing a relationship between the output voltage of each hole element and a distance in a case where the north (N) pole is detected. FIG. 16C is a third table showing a relationship between the output voltage of each hole element and a distance in a case where south the inverted-north (N) pole is detected.

Figure 17:
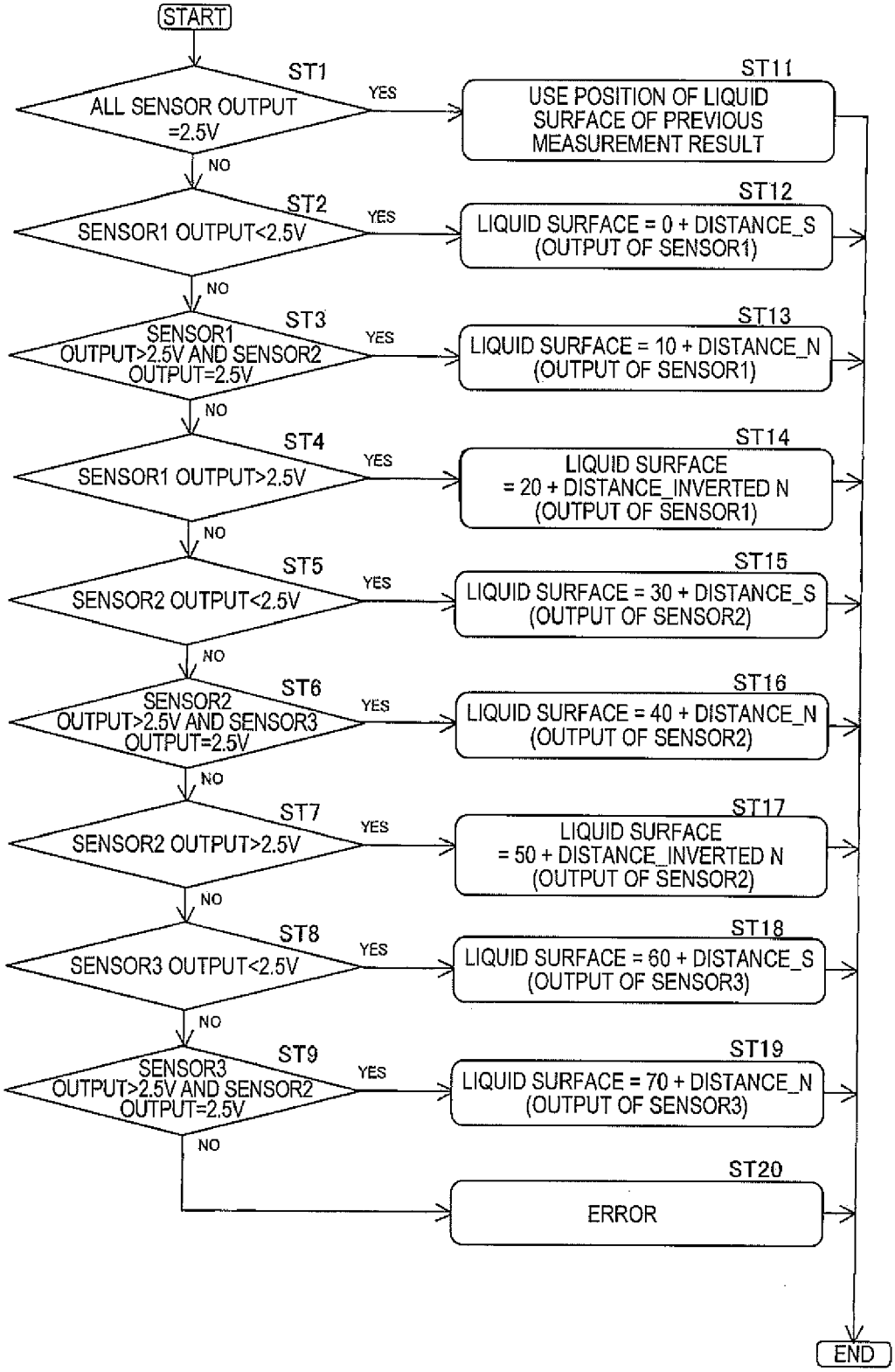
FIG. 17 is a flowchart of a process for converting the outputs of the hole elements into distances according to an embodiment of the invention.

FIG. 17 is a flowchart of a process for converting the outputs of the hole elements 113Y, 114Y, and 115Y into distances.

First, in Step 1, it is determined whether outputs of all the hole elements 113Y, 114Y, and 115Y are 2.5 V (ST1).

When the outputs of all the hole elements 113Y, 114Y, and 115Y are 2.5 V in Step 1, the result of the previous measurement is supposed to be used as the position of the liquid surface in Step 11 (ST11), and the process ends. On the other hand, when the outputs of all the hole elements 113Y, 114Y, and 115Y are not 2.5 V in Step 1, it is determined whether the output of the first hole element 113Y is lower than 2.5 V in Step 2 (ST2).

In Step 2, when the output of the first hole element 113Y is smaller than 2.5 V, the position of the liquid surface is set to a value that is acquired from the first table as a distance corresponding to the output of the first hole element 113Y (ST12), and the process ends. On the other hand, when the output of the first hole element 113Y is higher than 2.5 V in Step 2, in Step 3, it is determined whether the output of the second hole element 114Y is 2.5 V with the output of the first hole element 113Y higher than 2.5 V (ST3).

When the condition in Step 3 is satisfied, in Step 13, the position of the liquid surface is set as a value acquired from adding 10 mm to a value acquired from the second table as a distance corresponding to the output of the first hole element 113Y (ST13), and the process ends. On the other hand, when the condition in Step 3 is not satisfied, in Step 4, it is determined whether the output of the first hole element 113Y is higher than 2.5 V (ST4).

When the condition in Step 4 is satisfied, in Step 14, the position of the liquid surface is set as a value acquired from adding 20 mm to a value acquired from the third table as a distance corresponding to the output of the first hole element 113Y (ST14), and the process ends. On the other hand, when the condition in Step 4 is not satisfied, in Step 5, it is determined whether the output of the second hole element 114Y is lower than 2.5 V (ST5).

When the condition in Step 5 is satisfied, in Step 15, the position of the liquid surface is set as a value acquired from adding 30 mm to a value acquired from the first table as a distance corresponding to the output of the second hole element 114Y (ST15), and the process ends. On the other hand, when the condition in Step 5 is not satisfied, in Step 6, it is determined whether the output of the third hole element 115Y is 2.5 V with the output of the second hole element 114Y higher than 2.5 V (ST6).

When the condition in Step 6 is satisfied, in Step 16, the position of the liquid surface is set as a value acquired from adding 40 mm to a value acquired from the second table as a distance corresponding to the output of the second hole element 114Y (ST16), and the process ends. On the other hand, when the condition in Step 16 is not satisfied, in Step 7, it is determined whether the output of the second hole element 114Y is higher than 2.5 V (ST7).

When the condition in Step 7 is satisfied, in Step 17, the position of the liquid surface is set as a value acquired from adding 50 mm to a value acquired from the third table as a distance corresponding to the output of the second hole element 114Y (ST17), and the process ends. On the other hand, when the condition in Step 7 is not satisfied, in Step 8, it is determined whether the output of the third hole element 115Y is lower than 2.5 V (ST8).

When the condition in Step 8 is satisfied, in Step 18, the position of the liquid surface is set as a value acquired from adding 60 mm to a value acquired from the first table as a distance corresponding to the output of the third hole element 115Y (STI8), and the process ends. On the other hand, when the condition in Step 8 is not satisfied, in Step 9, it is determined whether the output of the second hole element 114Y is 2.5 V with the output of the third hole element 115Y higher than 2.5 V (ST9).

When the condition in Step 9 is satisfied, in Step 19, the position of the liquid surface is set as a value acquired from adding 70 mm to a value acquired from the third table as a distance corresponding to the output of the third hole element 115Y (ST19), and the process ends. On the other hand, when the condition in Step 9 is not satisfied, in Step 10, an error is determined (ST10), and the process ends.

Figure 18:
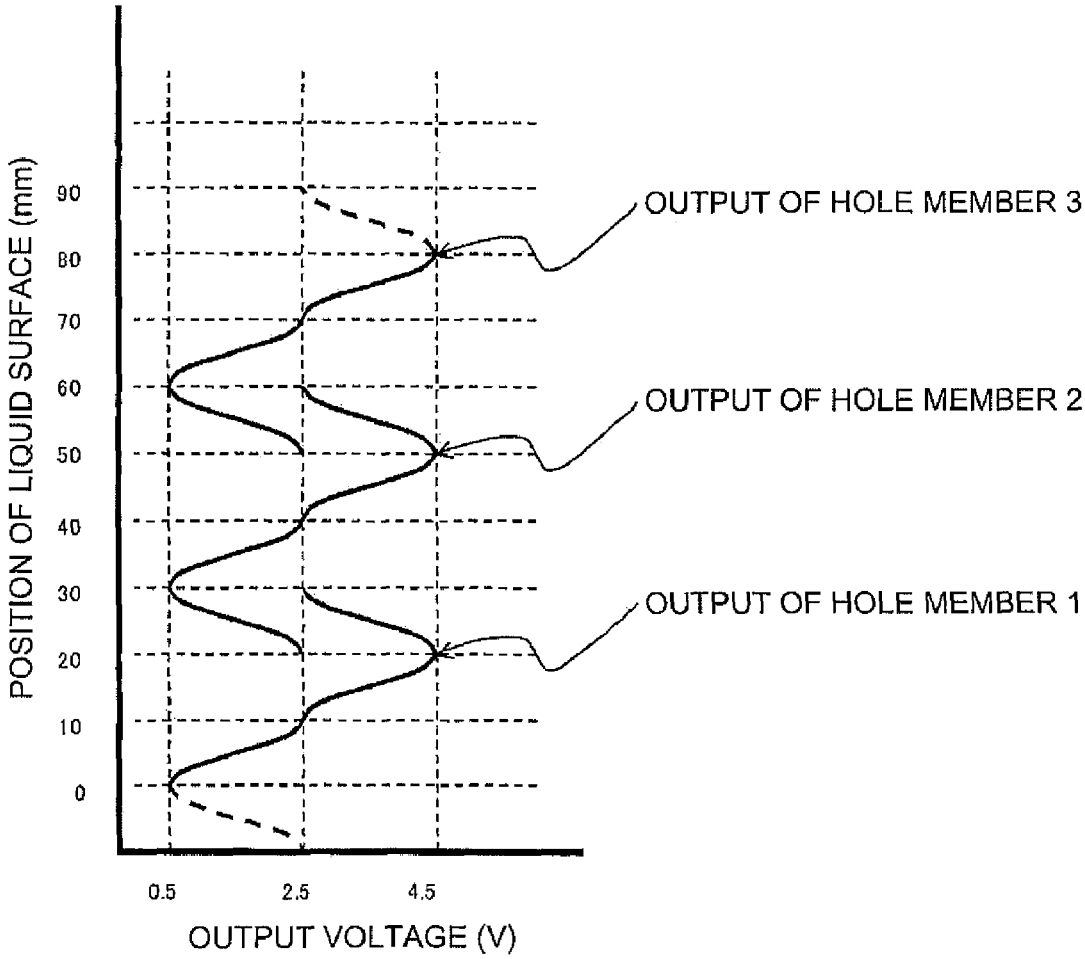
FIG. 18 is a diagram showing the result acquired from performing the process of the flowchart shown in FIG. 17.

FIG. 18 is a diagram showing the result acquired from performing the process of the flowchart shown in FIG. 17. As shown in FIG. 18, the position of the liquid surface corresponding to the outputs of the hole elements 113Y, 114Y, and 115Y can be acquired.

According to the above-described liquid measuring device 110Y, the number of components can be decreased and the costs can be suppressed to below. In addition, a long distance can be detected, and thereby halt of the system can be suppressed.

Next, control of the developer pump 76Y and the carrier liquid pump 79Y will be described. The control amounts of the developer pump 76Y and the carrier liquid pump 79Y are controlled by the amount of toner contained in the liquid developer or the amount of shortage of the carrier liquid.

First, the amount of toner contained in the liquid developer and the amount of the carrier liquid are calculated by using the liquid measuring device 110Y and the density measuring device 120Y shown in FIG. 15. Then, the amount of shortage for a reference value of the density of the liquid developer which is stored in advance is calculated.

Figure 19:
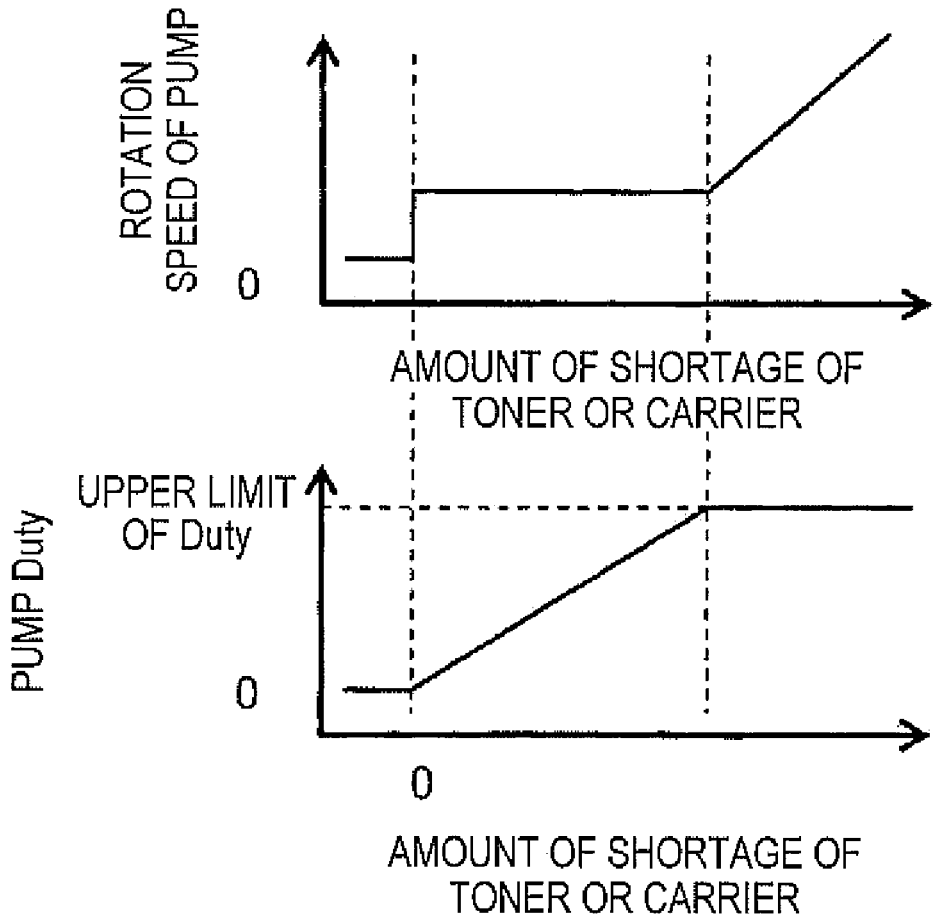
FIG. 19 is a diagram showing rotation speeds and duty values of a developer pump and a carrier liquid pump for the amount of shortage of toner or the carrier liquid according to an embodiment of the invention.

FIG. 19 is a diagram showing rotation speeds and duty values of the developer pump 76Y and the carrier liquid pump 79Y for amount of shortage of toner or the carrier liquid. As shown in FIG. 19, the developer pump 76Y and the carrier liquid pump 79Y have constant rotation speeds up to the upper limits of the duty values, and the duty values thereof are changed in accordance with the amount of shortage. After the upper limits of the duty values are reached, the numbers of rotations are increased in accordance with the amounts of shortage.

Figure 20:
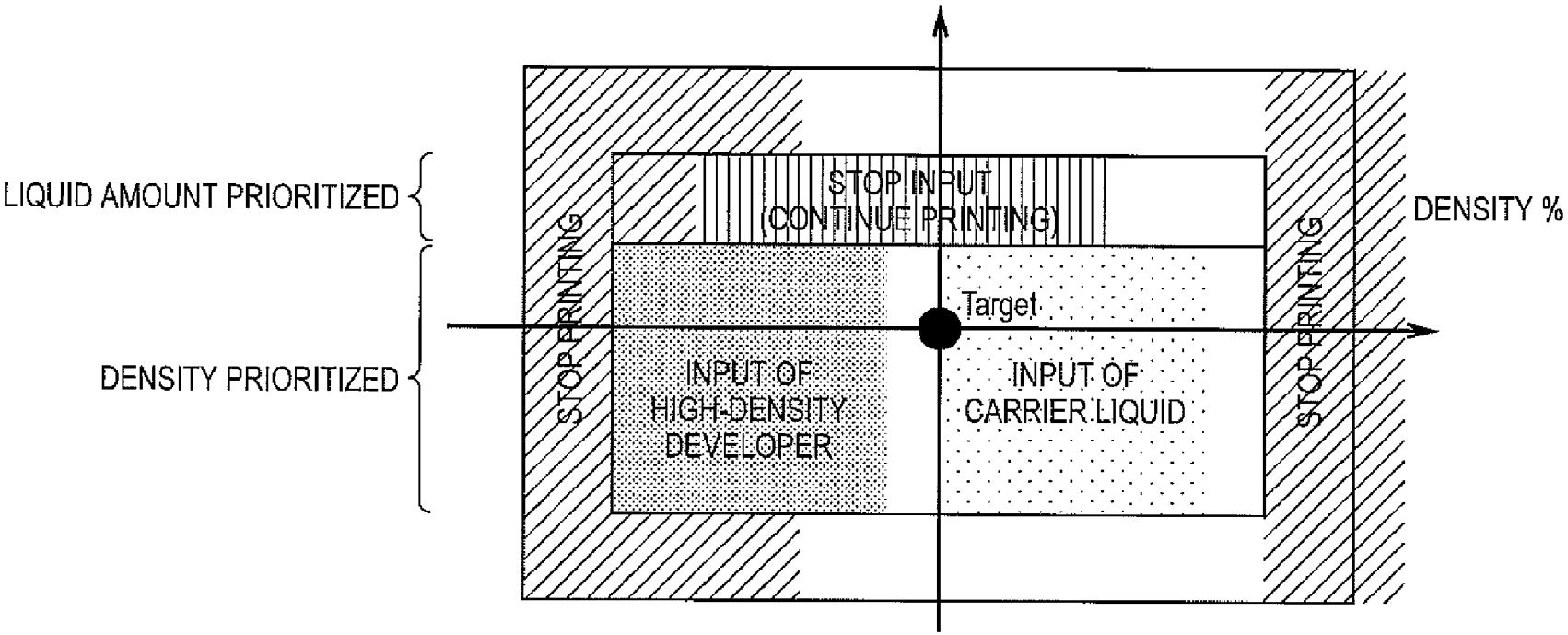
FIG. 20 is a diagram showing priorities of control for the amount and density of the liquid developer inside a liquid developer storing unit according to an embodiment of the invention.

Next, a control process for priority of control in a printing state will be described. FIG. 20 is a diagram showing priorities of control for the amount and density of the liquid developer inside the liquid developer storing unit 71Y.

As shown in FIG. 20, the density is prioritized with respect to the liquid amount of up to a certain degree. On the other hand, when the liquid amount exceeds the certain degree, the liquid amount is prioritized.

For example, up to a liquid amount of a specific degree, the density is prioritized. Thus, when the density is first density that has a value larger than a reference value, the carrier liquid is input from the carrier liquid tank 77Y to the liquid developer storing unit 71Y. On the other hand, when the density is second density that has a value smaller than the reference value, high-density developer is input from the developer tank 74Y to the liquid developer storing unit 71Y. In a case where the liquid amount is prioritized, when the liquid amount becomes a first liquid level that is higher than a first predetermined liquid level, input of the carrier liquid and the high-density developer is stopped regardless of the density. In addition, printing is continued. When the density is third density that is higher than the first predetermined density or fourth density that is lower than a second predetermined density set lower than the first predetermined density, printing is stopped. In addition, when the liquid amount is beyond the range of the specific degree, printing is stopped.

Next, a method of controlling the density of the liquid developer, according to an embodiment of the invention, will be described. Here, it is assumed that the target density of the liquid developer inside the liquid developer storing unit 71Y is 20%, the target liquid level is 100 mm, a liquid level for stopping input is 115 mm, a first liquid level (upper limit) for stopping printing is 120 mm, a second liquid level (lower limit) for stopping printing is 90 mm, the density of liquid developer inside the developer tank 74Y is 35%, the type of the carrier is LPO, and the image point rate is 30%.

In such a case, the rotation speeds and duty values of the developer pump 76Y and the carrier liquid pump 79Y for values detected by the density measuring device 120Y and the liquid measuring device 100Y are shown in Table 1.

| Toner density | Liquid level | Developer | | Carrier | | |
|---|---|---|---|---|---|---|
| (%) | (mm) | duty | RPM | duty | RPM | Control mode |
| 19 | 95 | 66 | 600 | 0 | 0 | Density |
| 17 | 105 | 100 | 909 | 0 | 0 | prioritized |
| 20 | 100 | 36 | 600 | 0 | 0 | |
| 21 | 95 | 0 | 0 | 100 | 802 | |
| 23 | 105 | 0 | 0 | 68 | 600 | |
| 18 | 116 | 0 | 0 | 0 | 0 | Liquid level |
| 22 | 118 | 0 | 0 | 0 | 0 | prioritized |
| 18 | 120 | 0 | 0 | 0 | 0 | Stop printing |
| 22 | 90 | 0 | 0 | 0 | 0 | |

As shown in Table 1, when the values detected by the density measuring device 120Y and the liquid measuring device 110Y are the liquid developer density of 19% and the liquid level of 95 mm, the developer pump 76Y is driven at the duty value of 66% and the rotation speed of 600 rpm. For example, when a control period is 5 seconds, the developer pump 76Y is driven for 3.3 seconds, and for the remaining 1.7 seconds, driving the developer pump 76Y is stopped. In addition, the carrier liquid pump 79 is stopped for 5 seconds. After 5 seconds elapses, control of the developer liquid pump 76Y and the carrier liquid pump 79Y is performed based on values newly detected by the density measuring device 120Y and the liquid measuring device 110Y.

When the liquid developer density is 17% and the liquid level of 105 mm, the developer pump 76Y is driven at the duty value of 100% and the rotation speed of 909 rpm. In addition, the carrier liquid pump 79 is stopped for 5 seconds. On the other hand, when the liquid developer density is 18% and the liquid level of 116 mm, the developer pump 76Y and the carrier liquid pump 79 are stopped for 5 seconds with printing continued. When the liquid developer density is 18% and the liquid level of 120 mm, printing is stopped.

In addition, it may be configured that the speeds of the developer compressing roller 22Y and the developer supplying roller 32Y are controlled based on the density detected by the density measuring device 120Y and the density of the developer in the developing nip is controlled.

First, an embodiment for controlling the speed of the developer supplying roller 32Y based on the density of the liquid developer which is detected by the density measuring device 120Y will be described. The density measurement by using the density measuring device 120Y is performed for every 4 pages (4.8 seconds) in a printing process. The number of revolutions of the developer supplying roller 32Y is changed between paper sheets in accordance with the density of the liquid developer which is detected by the density measuring device 120Y, as is needed.

Figure 21:
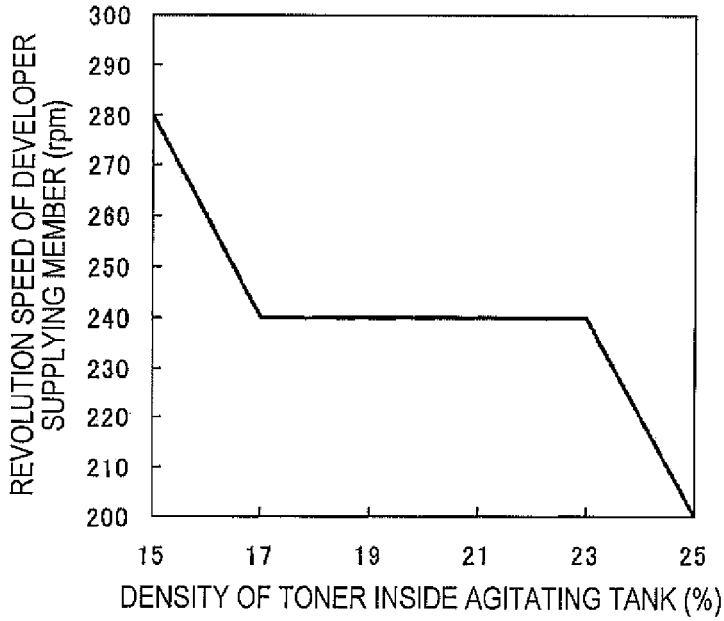
FIG. 21 is a graph showing an example of controlling the speed of a developer supplying roller in accordance with density of liquid developer according to an embodiment of the invention.

FIG. 21 is a graph showing an example of controlling the speed of the developer supplying roller 32Y based on the density of solids of the liquid developer. When the density of the solids of the liquid developer which is detected by the density measuring device 120Y is in the range of 17% to 23%, the rotation speed of the developer supplying roller 32Y is controlled to be a fixed speed of 240 rpm. When the density of the solids of the liquid developer which is detected by the density measuring device 120Y is in the range of 15% to 17%, the rotation speed of the developer supplying roller 32Y is controlled to be increased as the density decreases. Thus, when the density of the solids of the liquid developer is 15%, the rotation speed of the developer supplying roller 32Y is controlled to be 280 rpm. On the other hand, when the density of the solids of the liquid developer which is detected by the density measuring device 120Y is in the range of 23% to 25%, the rotation speed of the developer supplying roller 32Y is controlled to be decreased as the density increases. Thus, when the density of the solids of the liquid developer is 25% the rotation speed of the developer supplying roller 32Y is controlled to be 200 rpm.

Next, an embodiment for controlling the bias of the developer compressing roller 22Y in accordance with the density of the solids of the liquid developer which is detected by the density measuring device 120Y will be described. The density measurement by using the density measuring device 120Y is performed for every 4 pages (4.8 seconds) in a printing process. The current of the developer compressing roller 22Y is changed between paper sheets in accordance with the density of the liquid developer which is detected by the density measuring device 120Y, as is needed.

Figure 22:
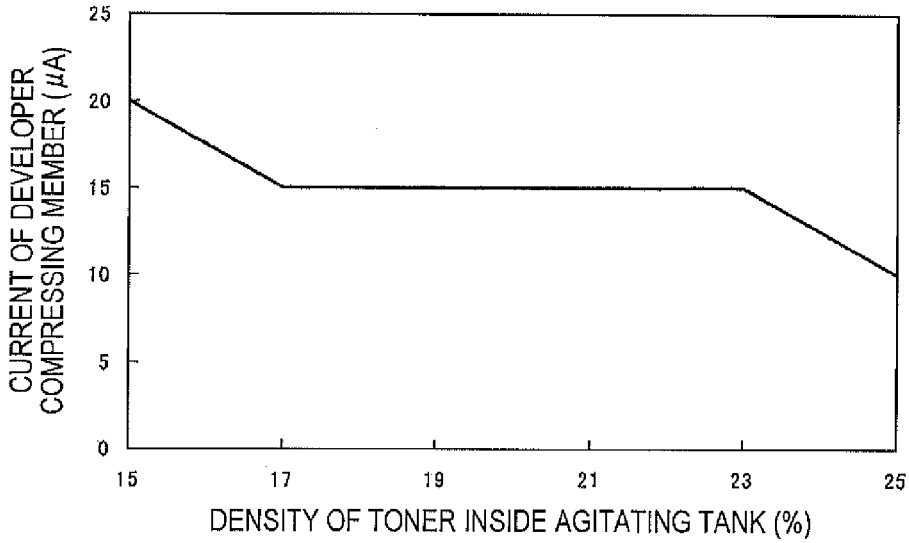
FIG. 22 is a graph showing an example of controlling the current of a developer compressing roller in accordance with density of liquid developer according to an embodiment of the invention.

FIG. 22 is a graph showing an example of controlling the current of the developer compressing roller 22Y in accordance with the density of the solids of the liquid developer. When the density of the solids of the liquid developer which is detected by the density measuring device 120Y is in the range of 17% to 23%, the current of the developer compressing roller 22Y is controlled to have a fixed value of 15 μA. When the density of the solids of the liquid developer which is detected by the density measuring device 120Y is in the range of 15% to 17%, the current of the developer compressing roller 22Y is controlled to be increased as the density decreases. Thus, when the density of the solids of the liquid developer is 15%, the current of the developer compressing roller 22Y is 20 μA. On the other hand, when the density of the solids of the liquid developer which is detected by the density measuring device 120Y is in the range of 23% to 25%, the current of the developer compressing roller 22Y is controlled to be decreased as the density increases. Thus, when the density of the solids of the liquid developer is 25%, the current of the developer compressing roller 22Y is 10 μA.

Figure 23:
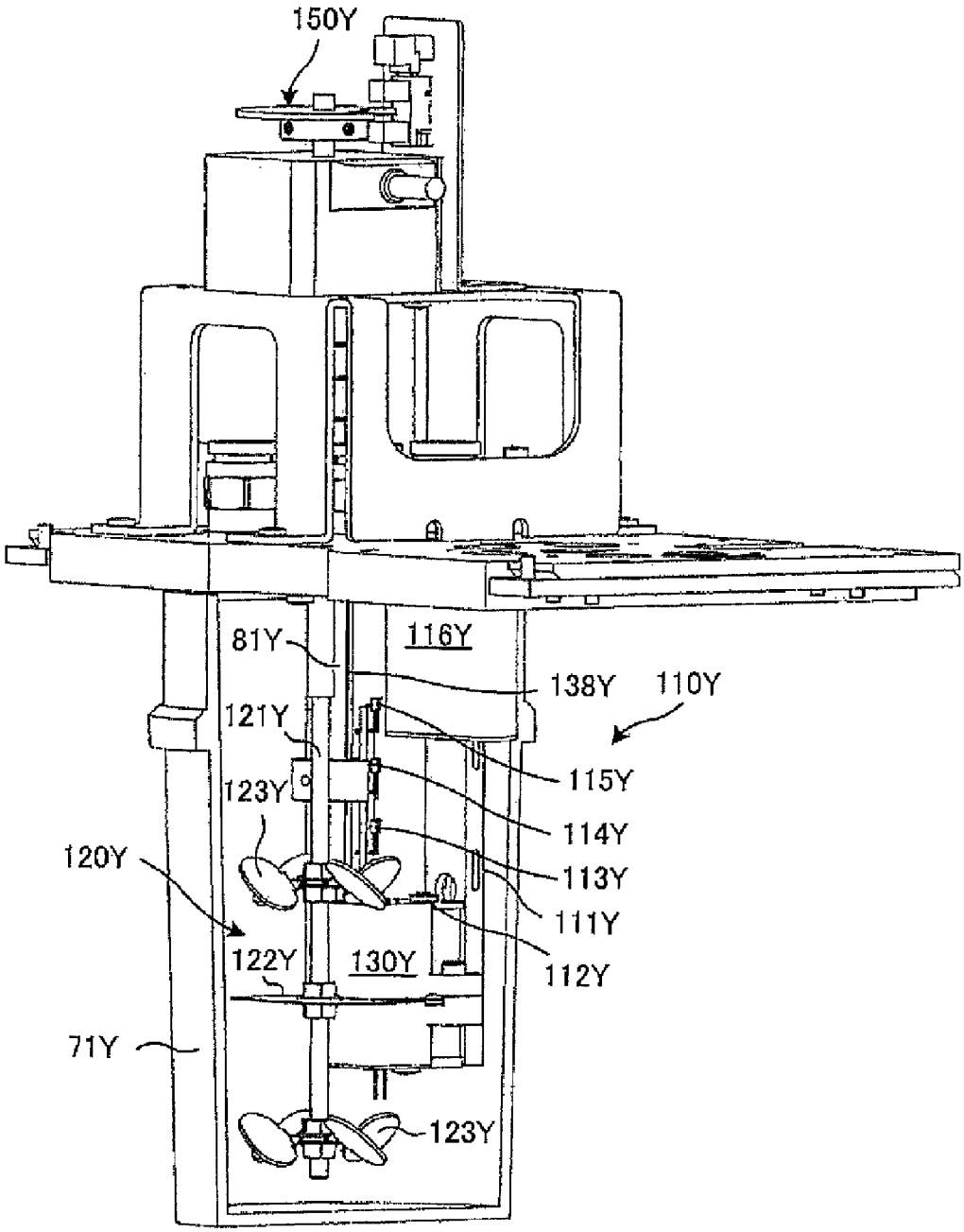
FIG. 23 is a perspective view of a liquid developer storing unit according to another embodiment of the invention.
Figure 24:
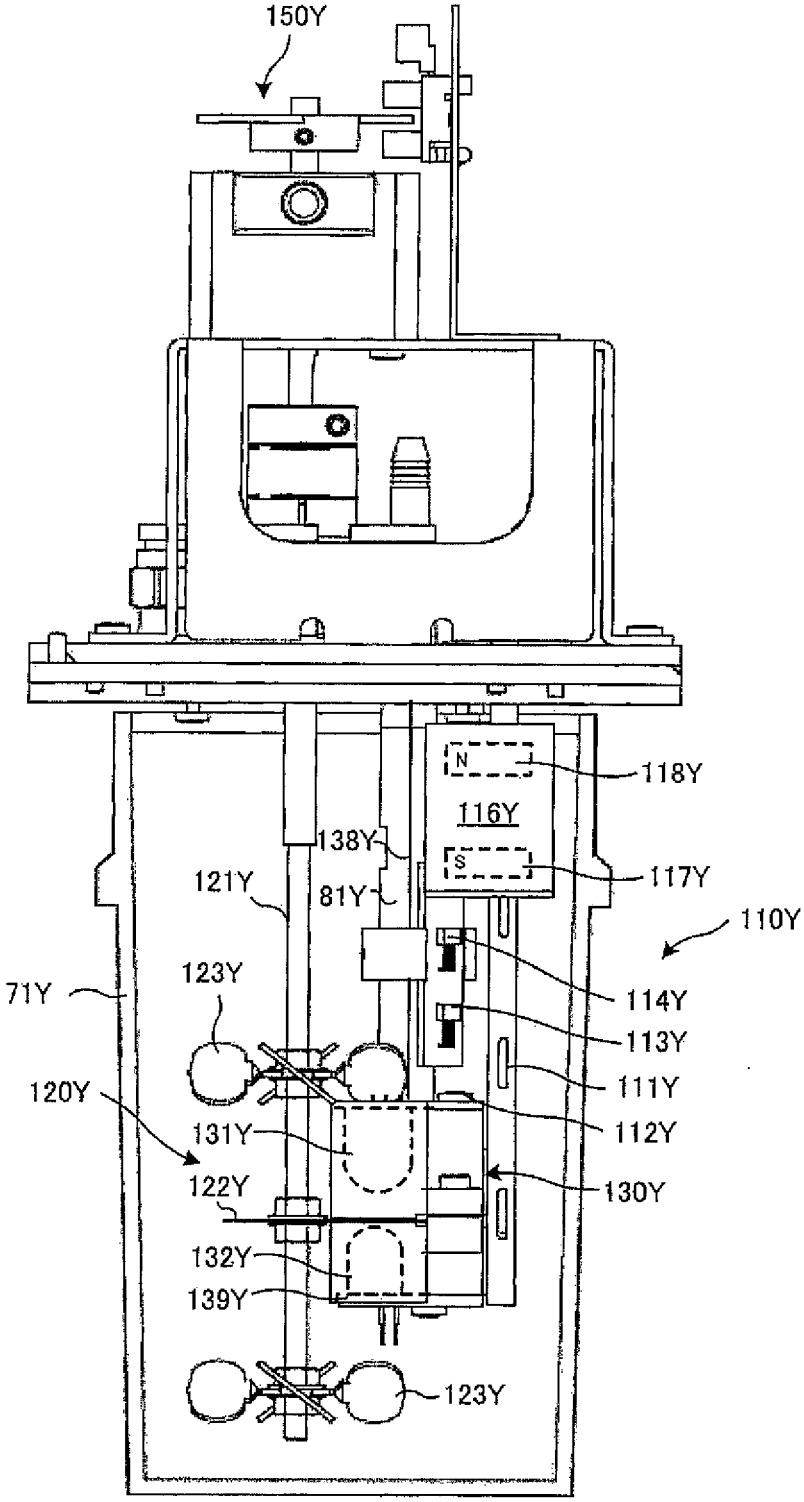
FIG. 24 is a cross-section view of a liquid developer storing unit according to another embodiment of the invention.
Figure 25:
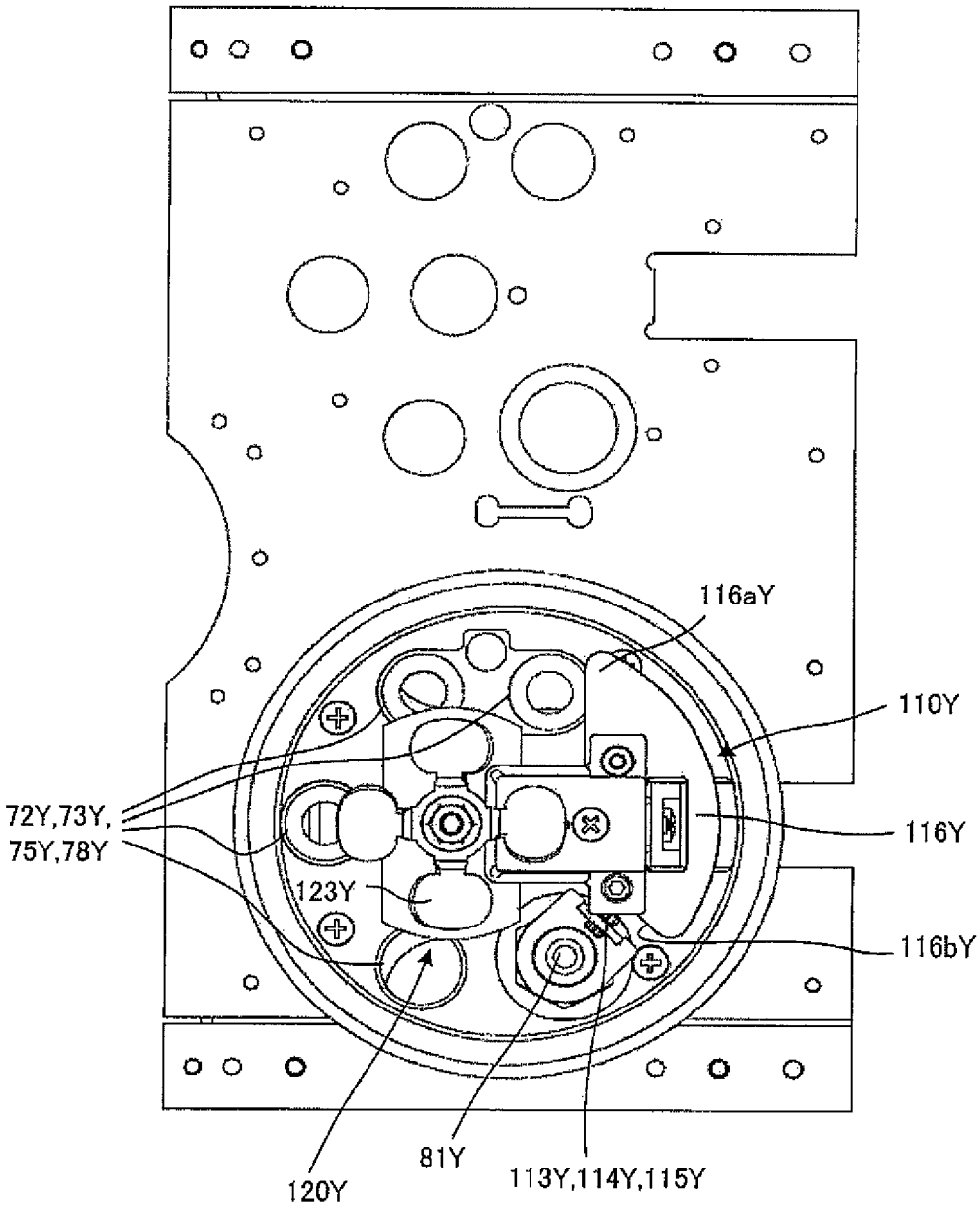
FIG. 25 is a diagram of a liquid developer storing unit according to another embodiment of the invention, viewed from the lower side.
Figure 26:
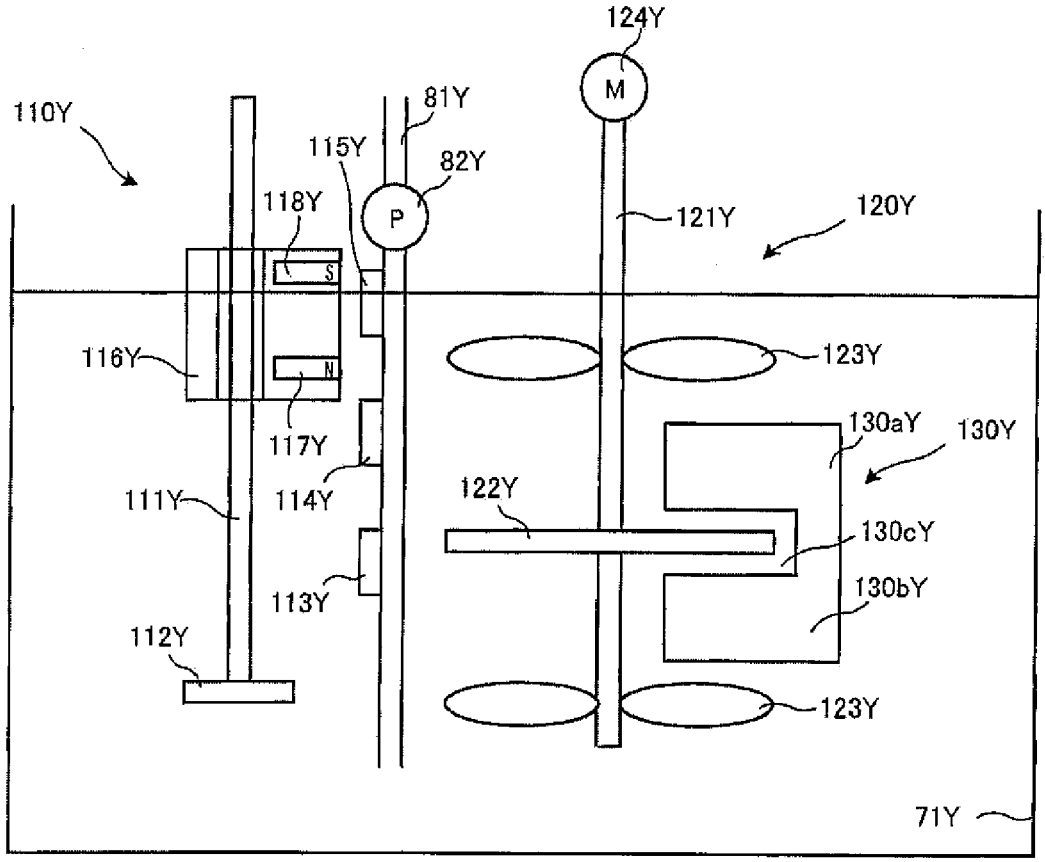
FIG. 26 is schematic diagram of a liquid developer storing unit according to another embodiment of the invention.

FIGS. 23 to 26 are diagrams showing a liquid measuring device 110Y and a density measuring device 120Y, located inside the liquid developer storing unit 71Y, according to another embodiment of the invention. FIG. 23 is a perspective view of a liquid developer storing unit according to another embodiment of the invention. FIG. 24 is a cross-section view of a liquid developer storing unit according to another embodiment of the invention. FIG. 25 is a diagram of a liquid developer storing unit according to another embodiment of the invention, viewed from the lower side. FIG. 26 is a schematic diagram of a liquid developer storing unit according to another embodiment. The liquid measuring device 110Y and the density measuring device 120Y, located inside the liquid developer storing unit 71Y measure the liquid level and the density of the liquid developer, as shown in FIG. 14. In this embodiment, the first hole element 113Y, the second hole element 114Y, and the third hole element 115Y are disposed in the developer supplying path 81Y used for supplying the liquid developer from the liquid developer storing unit 71Y to a supply unit 31*b*Y of the developer container 31Y.

First, the liquid measuring device 110Y as a liquid level sensor will be described. The liquid measuring device 110Y has a float supporting member 111Y, a regulating member 112Y, a first hole element 113Y, a second hole element 114Y, and a third hole element 115Y that are example of proportional output-type hole elements, a float 116Y as an example of a floating member, and first and second magnetic field generators 117Y and 118Y.

The float supporting member 111Y supports the float 116Y to be movable from a position on the liquid surface inside the liquid developer storing unit 71Y of yellow to a measurable position below the liquid surface. The regulating member 112Y is disposed in the density measuring unit 130Y of the density measuring device 120Y and prevents interferences of the float 116Y and the density measuring unit 130Y.

The first hole element 113Y, the second hole element 114Y, and the third hole element 115Y are sequentially disposed from the lower side with a predetermined distance apart from the developer supplying path 81Y through a bracket or the like.

The first hole element 113Y, the second hole element 114Y, and the third hole element 115Y are formed of proportional output-type hole members of which output voltage changes in accordance with magnetic flux density. In this embodiment, the distance between the hole elements is set to 30 mm.

The float 116Y is a member that is movable relative to the float supporting member 111Y by floating on the liquid surface in accordance with the position of the liquid surface. On the lower side of the float 116Y, the first magnetic field generator 117Y is disposed, and the second magnetic field generator 118Y is disposed on the upper side thereof to be a predetermined distance apart from the first magnetic field generator 117Y. The first magnetic field generator 117Y and the second magnetic field generator 118Y are disposed to be moved in accordance with movement of the float 116Y with facing the hole elements 113Y, 114Y, and 115Y. The first magnetic field generator 117Y and the second magnetic field generator 118Y are disposed to have the north (N) pole and the south (S) pole disposed on opposite sides. In this embodiment, the first magnetic field generator 117Y faces its south (S) pole toward the hole elements 113Y, 114Y, and 115Y, and the second magnetic field generator 117Y faces its north (N) pole toward the hole elements 113Y, 114Y, and 115Y. The magnetic field generators 117Y and 118Y having a diameter of 5 mm, a length of 6 mm, and 4000 Gauss are disposed to be spaced apart by 20 mm.

When the liquid surface of the liquid developer changes, the float 116Y is moved, and accordingly, distances between the first and second magnetic field generators 117Y and 118Y and the hole elements 113Y, 114Y, and 115Y are changed. In accordance with the changes in the distances, magnetic fields detected by the hole elements 113Y, 114Y, and 115Y change, and thus, it is possible to acquire the liquid level based on the detected values of the hole elements 113Y, 114Y, and 115Y.

The density measuring device 120Y has an agitating propeller shaft 121Y, a transparent propeller 122Y as an example of a moving member, an agitating propeller 123Y as an example of an agitating member, and a density measuring unit 130Y. The transparent propeller 122Y and the agitating propeller 123Y are disposed in a same shaft that is the agitating propeller shaft 121Y, and the agitating propeller shaft 121Y is a member that is rotated by a motor 124Y.

Since the structure of the density measuring unit 130Y is almost the same as that shown in FIGS. 11 and 12, a description of a same element will be omitted here.

The density measuring unit 130Y has a case formed of an insulating member such as plastic. The case has a gap 130*c*Y, and the transparent propeller 122Y is supported by the agitating propeller shaft 121Y and is formed of a member having a flat plate shape such as a rectangle that can be rotatable. The transparent propeller 122Y has a structure for intermittently passing a gap 130*c*Y between first and second members 130*a*Y and 130*b*Y of the density measuring unit 130Y. The first member 130*a*Y or the second member 130*b*Y can be moved, and thus a distance of the gap 130*c*Y can be changed. The distance of the gap 130*c*Y may be changed in accordance with the color of the liquid developer.

The density measuring unit 130Y has a light emitting diode (LED) 131Y as a light emitting member, a density-measuring light receiving element 132Y as a first light emitting member, a emission intensity-measuring light receiving element 133Y as a second light emitting member, and the like, and wirings 138Y thereof are disposed in the developer supplying path 81Y. The density-measuring light receiving element 132Y, the emission intensity-measuring light receiving element 133Y, and the like are supported by a metal plate 139Y that is electrically floating, and accordingly, it is possible to reduce electrical influence on the density measuring unit 130Y.

In addition, the liquid measuring device 110Y and the density measuring device 120Y have a height adjusting mechanism 150Y that can adjust a vertical position. Thus, the whole position can be adjusted, and accordingly, the degree of freedom for design increases.

As shown in FIG. 25, when this embodiment is viewed from the lower side, the agitating propeller 123Y is rotated in the clockwise direction and is disposed to be overlapped with at least one of openings of the developing unit collecting path 72Y, the image carrier collecting path 73Y, the developer supplying path 75Y, and the carrier liquid supplying path 78Y. Accordingly, newly collected or supplied liquid developer can be agitated in a speedy manner.

In addition, the float 116Y has a fan-shaped section, and an end part 116*a*Y of the float 116Y opposite to the hole elements 113Y, 114Y, and 115Y has a rounded acute-angled shape so as to enable the liquid developer to flow in an easy manner. In addition, a face 116*b*Y of the float 116 opposite to the end part 116*a*Y faces the hole elements 113Y, 114Y, and 115Y. Accordingly, the flow of the liquid developer is reduced, and the precision of the hole elements 113Y, 114Y, and 115Y is improved.

Figure 27:
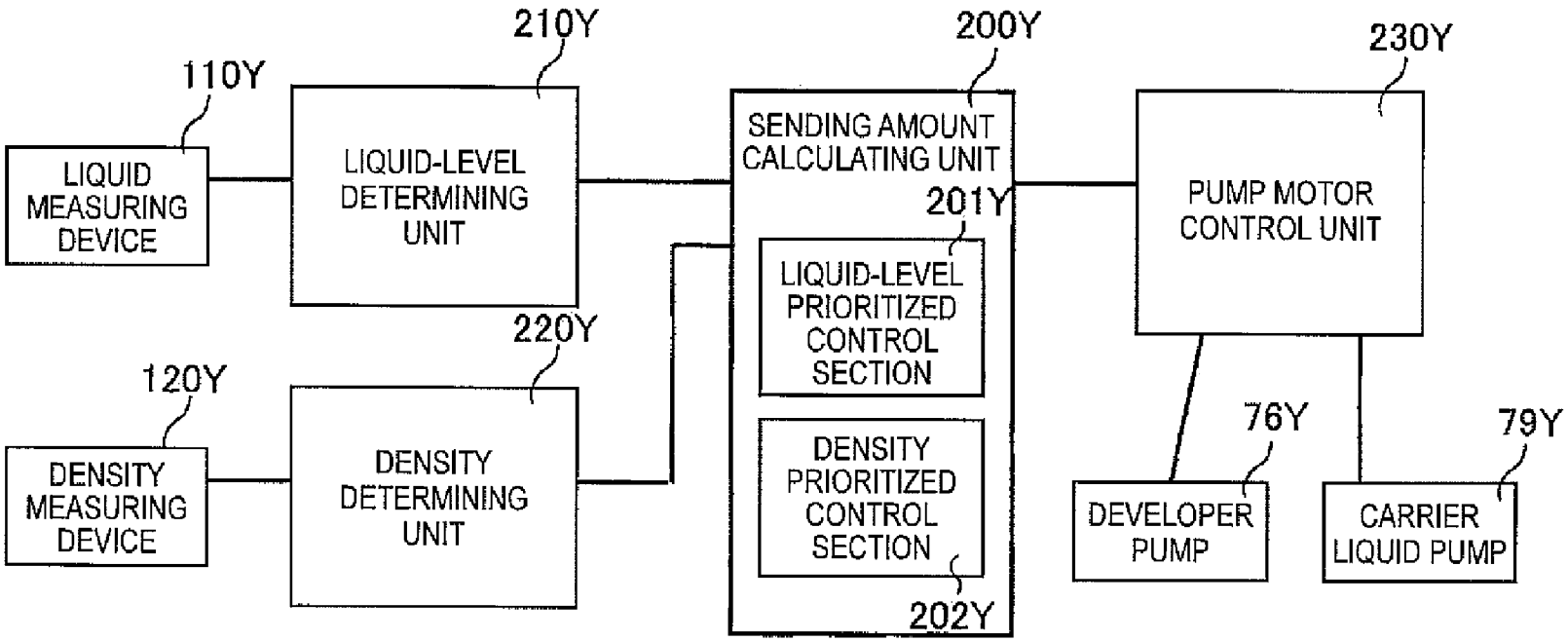
FIG. 27 is a block diagram showing a relationship of a liquid measuring device, a density measuring device, and a developer collecting and supplying device according to an embodiment of the invention.

FIG. 27 is a block diagram showing a relationship of the liquid measuring device 10Y, the density measuring device 120Y, and the developer collecting and supplying device 70Y according to an embodiment of the invention.

A liquid level determining unit 210 determines whether the liquid level measured by the liquid measuring device 110Y is higher than a predetermined level. When the liquid level determining unit 210 determines that the liquid level measured by the liquid measuring device 110Y is higher than the predetermined level, a liquid sending amount calculating unit 200 sets the liquid amount prioritizing mode and outputs a signal from a liquid-level priority control section 201 to a pump motor control unit 230 so as to prohibit input of the liquid developer. The pump motor control unit 230 prohibits operation of pump motors such as the developer pump 79Y, the carrier liquid pump 76Y, and the like so as to prohibit input of the liquid developer. Accordingly, an overflow and the like can be prevented.

In addition, it is determined whether the density measured by the density measuring device 120Y is higher than a first or second predetermined density by the density determining unit 220. When the density determining unit 220 determines that the density measured by the density measuring device 120Y is higher than the first predetermined density or is lower than the second predetermined density that is lower than the first predetermined density, the density determining unit 220 sets the density prioritized mode and stops printing by using a density prioritized control unit 202. Accordingly, an image is not formed with a deteriorated image quality.

As described above, the image forming apparatus according to an embodiment of the invention has a liquid-amount prioritizing mode in which the developer collecting and supplying device 70Y is controlled based on the result of measurement of the liquid measuring device 110Y and a density prioritizing mode in which the developer collecting and supplying device 70Y is controlled based on the result of measurement of the density measuring device 120Y. Accordingly, the image forming apparatus can be controlled based on the liquid amount and density of the liquid developer, and thereby an image with excellent image quality can be formed in accordance with the state of the liquid developer.

In addition, the liquid developer storing device according to an embodiment of the invention is configured by the liquid developer storing unit 71Y, the liquid measuring device 110Y, the density measuring device 120Y, and the like. The output of the first light receiving member for a case where the moving member is moved in the light path is the first output, the output of the first light receiving member for a case where the moving member is not in the light path is the second output, and the output of the second light receiving member for a case where the second light receiving member receives light not through the moving member is the third output. In descriptions here, the density represents the density of the solids of the liquid developer.

As described above, the method of measuring density according to an embodiment of the invention includes: detecting movement of a transparent propeller 122Y in a light path of light emitted from a light emitting diode (LED) 131Y; measuring an output of a light receiving element 132Y for a case where the transparent propeller 122Y is moved in the light path, as a first output; detecting that the transparent propeller 122Y is not in the light path; measuring an output of the light receiving element 132Y for a case where the transparent propeller 122Y is not in the light path, as a second output; and calculating density based on the first output and the second output. Accordingly, the liquid is not needed to be pumped from the liquid developer storing unit 71Y by using a pump or the like, and thus the number of components is decreased. In addition, since the transparent propeller 122Y is moved in the gap, a new liquid can come into the gap and accordingly, it is possible to precisely measure the density of the liquid.

In addition, the measuring of the first output of the density-measuring light receiving element 132Y for a case where the transparent propeller 122Y is moved in the light path includes receiving the light emitted from the light emitting diode (LED) 131Y through the transparent propeller 122Y that has optical transparency by using the light receiving element 132Y. Accordingly, it is possible to form a change in the light path that is formed from the light emitting diode (LED) 131Y to the density-measuring light receiving element 132Y in a simple manner.

In addition, the method includes: measuring an output of an emission intensity-measuring light receiving element 133Y for a case where the emission intensity-measuring light receiving element 133Y receives light emitted from the light emitting diode (LED) 131Y not through the transparent propeller 122Y, as a third output; and correcting the second output by using the third output. Accordingly, the density can be measured more accurately.

In addition, the method of adjusting density of a liquid developer storing unit includes: measuring an output of a light receiving element 132Y for a case where a transparent propeller 122Y is moved in a light path of light emitted from a light emitting diode (LED) 131Y of a liquid developer storing unit 71Y that stores liquid developer having solids and a liquid carrier, as a first output; measuring an output of the light receiving element 132Y for a case where the transparent propeller 122Y is not in the light path, as a second output; and calculating density of the solids of the liquid developer based on the first output and the second output; and supplying the liquid developer or the carrier liquid to the inside of the liquid developer storing unit 71Y in accordance with the calculated density of the solids. Accordingly, the density inside the liquid developer storing unit 71Y can be precisely adjusted.

In addition, the measuring of the first output of the density-measuring light receiving element 132Y for a case where movement of the transparent propeller 122Y in the light path is receiving light emitted from the light emitting diode (LED) 131Y through the transparent propeller 122Y having optical transparency by using the light receiving element 132Y. Accordingly, it is possible to form a change in the light path that is formed from the light emitting diode (LED) 131Y to the density-measuring light receiving element 132Y in a simple manner.

In addition, the method includes: measuring an output of the emission intensity-measuring light receiving element 133Y for a case where the emission intensity-measuring light receiving element 133Y receives light emitted from the light emitting diode (LED) 131Y not through the transparent propeller 122Y, as a third output; and correcting the second output by using the third output. Accordingly, the density can be measured more accurately.

In addition, the method includes supplying the liquid developer into the liquid developer storing unit 71Y in a case where the calculated density of the solids is the first density of the solids that has a value smaller than a predetermined value. Accordingly, it is possible to precisely adjust the density of the liquid developer in a case where the density of the liquid developer inside the liquid developer storing unit 71Y is low.

In addition, the method includes supplying the carrier liquid into the liquid developer storing unit 71Y in a case where the calculated density of the solids is the second density of the solids that has a value larger than the predetermined value. Accordingly, it is possible to precisely adjust the density of the liquid developer in a case where the density of the liquid developer inside the liquid developer storing unit 71Y is high.

In addition, the method includes: calculating a liquid level of the liquid developer inside the liquid developer storing unit 71Y; and supplying the liquid developer or the carrier liquid into the liquid developer storing unit 71Y based on calculated the liquid level. Accordingly, it is possible to precisely adjust the density of the liquid developer inside the liquid developer storing unit 71Y.

In addition, the method includes prohibiting input of the liquid developer in a case where the liquid level is the first liquid level that is higher than a first predetermined liquid level. Accordingly, an overflow or the like from the liquid developer storing unit 71Y can be prevented.

In addition, the image forming method according to an embodiment of the invention includes: supplying liquid developer having solids and a liquid carrier which is stored in a developer container 31Y from a developer supplying member 32Y to a developer carrier 20Y; developing a latent image on an image carrier 10Y by using the liquid developer carried on the developer carrier 20Y; transferring the image of the image carrier 10Y on a transfer body 40; collecting the liquid developer from the developer container 31Y into the liquid developer storing unit 71Y; detecting that a transparent propeller 122Y is moved in a light path of light emitted from a light emitting diode (LED) 131Y of the liquid developer storing unit 71Y; measuring an output of the light receiving element 132Y for a case where the transparent propeller 122Y is moved in the light path, as a first output; detecting that the transparent propeller 122Y is not in the light path; measuring an output of the light receiving element 132Y for a case where the transparent propeller 122Y is not in the light path, as a second output; and calculating density of the solids of the liquid developer based on the first output and the second output; and changing an image forming condition based on the calculated density of the solids. Accordingly, an image having excellent image quality can be formed.

In addition, the image forming method includes supplying the liquid developer or the carrier liquid to the inside of the liquid developer storing unit 71Y in accordance with the calculated density of the solids. Accordingly, it is possible to precisely adjust the density of the liquid developer inside the liquid developer storing unit 71Y, and therefore an image having higher image quality can be formed.

In addition, the image forming method includes stopping printing in a case where the calculated density of the solids is a third density of the solids that is higher than a first predetermined density or a fourth density that is lower than a second predetermined density lower than the first predetermined density. Accordingly, formation of an image having deteriorated image quality can be reduced.

In addition, the image forming method includes controlling the number of rotations of the developer supplying member 32Y in accordance with the calculated density of the solids. Accordingly, it is possible to form an image having higher image quality.

In addition, the image forming method includes controlling a bias of a developer compressing member 22Y in accordance with the calculated density of the solids. Accordingly, it is possible to form an image having higher image quality.

The entire disclosure of Japanese Patent Application Nos: 2007-217849, filed Aug. 24, 2007 and 2008-167193, filed Jun. 26, 2008 are expressly incorporated by reference herein.

What is claimed is:

1. A method of measuring density comprising:

detecting movement of a moving member in a single unaltered light path of light emitted from a light emitting member;

measuring an output of a light receiving member for a case where the moving member is moved in the single unaltered light path, as a first output;

detecting that the moving member is moved out of the single unaltered light path previously occupied by the moving member;

measuring an output of the light receiving member for a case where the moving member is moved out of the single unaltered light path, as a second output; and calculating density based on the first output and the second output.

2. The method according to claim 1, wherein the measuring of the first output includes receiving the light emitted from the light emitting member through the moving member that has optical transparency by using the light receiving member.

3. The method according to claim 1, further comprising:

measuring an output of a second light receiving member for a case where the second light receiving member receives light emitted from the light emitting member not through the moving member, as a third output; and correcting the second output by using the third output.

4. A method of adjusting density of a liquid developer storing unit, the method comprising:

measuring an output of a light receiving member for a case where a moving member is moved in a single unaltered light path of light emitted from a light emitting member of a liquid developer storing unit that stores liquid developer having solids and a liquid carrier, as a first output;

measuring an output of the light receiving member for a case where the moving member is moved out of the single unaltered light path previously occupied by the moving member, as a second output;

calculating density of the solids of the liquid developer based on the first output and the second output; and supplying the liquid developer or the carrier liquid to the inside of the liquid developer storing unit in accordance with the calculated density of the solids.

5. The method according to claim 4, wherein the measuring of the first output is receiving light emitted from the light emitting member through the moving member having optical transparency by using the light receiving member.

6. The method according to claim 4, further comprising:

measuring an output of a second light receiving member for a case where the second light receiving member receives light emitted from the light emitting member not through the moving member, as a third output; and correcting the second output by using the third output.

7. The method according to claim 4, further comprising supplying the liquid developer into the liquid developer storing unit in a case where the calculated density of the solids is first density of the solids that is smaller than a predetermined value.

8. The method according to claim 4, further comprising supplying the carrier liquid into the liquid developer storing unit in a case where the calculated density of the solids is second density of the solids that is larger than the predetermined value.

9. The method according to claim 4, further comprising:

calculating a liquid level of the liquid developer inside the liquid developer storing unit; and supplying the liquid developer or the carrier liquid into the liquid developer storing unit based on calculated the liquid level.

10. The method according to claim 4, further comprising prohibiting input of the liquid developer in a case where the liquid level is a first liquid level that is higher than a first predetermined liquid level.

11. An image forming method comprising:

supplying liquid developer having solids and a liquid carrier which is stored in a developer container from a developer supplying member to a developer carrier;

developing a latent image on an image carrier by using the liquid developer carried on the developer carrier;

transferring the image of the image carrier by using a transfer member;

collecting the liquid developer from the developer container into the liquid developer storing unit;

detecting that a moving member is moved in a single unaltered light path of light emitted from a light emitting member of the liquid developer storing unit;

measuring an output of the light receiving member for a case where the moving member is moved in the single unaltered light path, as a first output;

detecting that the moving member is moved out of the single unaltered light path previously occupied by the moving member;

measuring an output of the light receiving member for a case where the moving member is moved out of the single unaltered light path, as a second output;

calculating density of the solids of the liquid developer based on the first output and the second output; and changing an image forming condition based on the calculated density of the solids.

12. The image forming method according to claim 11, further comprising supplying the liquid developer or the carrier liquid to the inside of the liquid developer storing unit in accordance with the calculated density of the solids.

13. The image forming method according to claim 11, further comprising stopping printing in a case where the calculated density of the solids is a third density of the solids that is higher than a first predetermined density or a fourth density that is lower than a second predetermined density lower than the first predetermined density.

14. The image forming method according to claim 11, further comprising controlling the number of rotations of the developer supplying member in accordance with the calculated density of the solids.

15. The image forming method according to claim 11, further comprising controlling a bias of a developer compressing member in accordance with the calculated density of the solids.

16. The image forming method according to claim 1, wherein the moving member holds a material whose density is measured.

* * * * *